US008066348B2

(12) United States Patent
Hirota et al.

(10) Patent No.: US 8,066,348 B2
(45) Date of Patent: Nov. 29, 2011

(54) IMAGE FORMING APPARATUS AND DEFECTIVE NOZZLE DETECTION METHOD

(75) Inventors: Tetsuro Hirota, Hadeno (JP); Takumi Hagiwara, Edina (JP); Kenichi Kawabata, Isehara (JP); Mamoru Yorimoto, Tarra (JP); Tetsu Morino, Zama (JP); Noboru Sawayama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 313 days.

(21) Appl. No.: 12/164,377

(22) Filed: Jun. 30, 2008

(65) Prior Publication Data

US 2009/0015621 A1 Jan. 15, 2009

(30) Foreign Application Priority Data

Jun. 28, 2007 (JP) ..... 2007-171091

(51) Int. Cl.
*B41J 2/01* (2006.01)

(52) U.S. Cl. ..... 347/19; 347/14; 347/5

(58) Field of Classification Search ..... 347/5, 9, 347/14, 19, 15
See application file for complete search history.

(56) References Cited

U.S. PATENT DOCUMENTS

| | | | | |
|---|---|---|---|---|
| 4,644,372 | A | 2/1987 | Hirota | |
| 4,661,822 | A | 4/1987 | Hirota et al. | |
| 5,239,164 | A | 8/1993 | Hirota | |
| 5,754,202 | A | 5/1998 | Sekiya et al. | |
| 5,818,482 | A | 10/1998 | Ohta et al. | |
| 5,821,953 | A | 10/1998 | Nakano et al. | |
| 6,053,597 | A | 4/2000 | Hirota | |
| 6,331,052 | B1 | 12/2001 | Murai et al. | |
| 6,454,380 | B1 * | 9/2002 | Endo | 347/19 |
| 2005/0052488 | A1 * | 3/2005 | Inoue | 347/19 |
| 2006/0092208 | A1 * | 5/2006 | Shoki et al. | 347/14 |

FOREIGN PATENT DOCUMENTS

| | | |
|---|---|---|
| JP | 6-297728 | 10/1994 |
| JP | 2005-59452 | 3/2005 |
| JP | 2005-104147 | 4/2005 |
| JP | 2006-178396 | 7/2006 |
| JP | 3838251 | 8/2006 |
| JP | 2006-272834 | 10/2006 |

OTHER PUBLICATIONS

U.S. Appl. No. 07/915,325, filed Jul. 16, 1992 (Abandoned).
U.S. Appl. No. 08/253,426, filed Jun. 2, 1994 (Abandoned).
Sep. 13, 2011 Japanese official action in connection with a counterpart Japanese patent.

* cited by examiner

*Primary Examiner* — Lam S Nguyen
(74) *Attorney, Agent, or Firm* — Cooper & Dunham LLP

(57) ABSTRACT

An image forming apparatus includes a recording head, a water-repellent transfer belt, a pattern formation controller, a read unit, and a detection unit. The recording head has a plurality of nozzles aligned in a given direction, and ejects droplets of a liquid therefrom. The pattern formation controller directs each of the plurality of nozzles to eject the liquid to form a detection pattern on the transfer belt. The detection pattern has multiple droplets ejected from each of the plurality of nozzles sequentially arranged and spaced apart from each other both in the given direction and in a direction orthogonal to the given direction. The read unit includes a light emitting element and a light receiving element, and reads the detection pattern to output a read result. The detection unit detects a defective nozzle according to the read result.

18 Claims, 18 Drawing Sheets

IMAGE FORMING APPARATUS AND DEFECTIVE NOZZLE DETECTION METHOD

TECHNICAL FIELD

The present disclosure relates to an image forming apparatus and a defective nozzle detection method, and more particularly, to an image forming apparatus using a recording head including a plurality of nozzles for ejecting ink and a method for detecting a defective nozzle for use in such an image forming apparatus.

DISCUSSION OF THE BACKGROUND

In image forming apparatuses, such as printers, facsimiles, copy machines, multifunctional machines, or the like, a liquid ejection device including a recording head or liquid ejection head is used to perform image formation (i.e., recording, printing, photo-printing, or character-printing) using recording liquid or ink. Commonly, such a recording head includes a plurality of nozzles for ejecting ink droplets, with which image formation is performed by ejecting and depositing ink onto a recording medium or recording sheet supported and moved on a media transferring member such as a transfer belt.

Note that "image forming apparatus" hereby refers to an apparatus that performs image formation by depositing recording liquid onto a medium such as paper, thread, fiber, cloth, leather, metal, plastic, glass, wood, ceramics, etc., and includes inkjet printers, textile printers, wiring circuit printers, and the like. Also, the term "image formation" refers to formation of images on recording media, including those with meanings, such as characters, pictures, etc., as well as those without concrete meanings, such as designs, patterns, etc. It should be noted that the recording liquid is not particularly limited and includes any liquid used for image formation.

Occasionally, recording heads used in image forming apparatuses suffer a nozzle defect, where a nozzle cannot properly eject droplets due to defects such as clogging with ink, etc. Since such a defect leads to degradation of image quality, e.g., white lines appearing on formed images, it has been a common practice to detect whether a recording head has a defective nozzle, and to restore the image forming apparatus to proper working condition upon detection of a nozzle defect.

Various methods have been developed to detect a nozzle defect in image forming systems. In one method proposed, a test pattern of dots made of cyan ink, magenta ink, and yellow ink is formed in a given region on the surface of a sheet transfer member. According to this method, the dot pattern is read by an RGB sensor, and a defective nozzle is detected based on an output of the RGB sensor.

Another detection method proposed includes a read unit for reading a test pattern, which is an image formed on a transfer member for holding and transferring a recording medium.

In addition, there has been a detection method for use in an electrophotographic image forming apparatus that uses toner for image formation, where density of a formed image is determined based on an output of a light sensor. The light sensor can simultaneously sense specular light and diffused light reflected from an image, which indicates the amount of toner adhering to a recording medium.

However, when using a test pattern formed on a transfer member for transferring a medium, for example, on a transfer belt as in the above methods, it is difficult to accurately detect the test pattern by identifying colors or by photographing, since, depending on the combination, a color difference between the test pattern and the transfer member can be too small to detect by the read unit. In this case, accurately detecting respective colors requires an expensive detection means such as light sources having different wavelengths for different colors.

Moreover, when using an electrostatic transfer belt having a front surface formed of an insulation layer and a back surface formed of a medium resistant layer to which carbon is blended to provide sufficient electric conductivity, it is difficult to accurately detect the test pattern by sensing a color difference or by photographing since the electrostatic belt is black in color and is hardly discernible from black ink.

In the above-mentioned detection method using the RGB sensor, detection accuracy is deteriorated when the color of an ink droplet to be ejected is similar to that of the transfer member. Therefore, a good detection accuracy is obtained only with limited variations of color inks for a particular transfer member to form the test pattern thereon. Further, when configuring the RGB sensor using a laser that has a significantly tiny spot diameter, detection accuracy is lowered when small foreign matters or scratches on the transfer member affect the laser scanning performance. Such a method is also disadvantageous in terms of cost, since the RGB sensor requires multiple elements for reading respective colors.

To cope with the above problem, it is considered to apply the above-mentioned detection method for use in an electrophotographic system to an inkjet printing system. However, directly applying such a method cannot achieve accurate detection of an ink pattern. An electrophotographic system can perform pattern detection using the test pattern according to the detection method in which toner particles, which remain stable in shape when in contact with each other, are collected and piled up in a rectangular line. By contrast, liquid droplets tend to aggregate when disposed in contact with each other, so that it is difficult, if not impossible, to detect a test pattern formed by closely depositing ink droplets, and detection using such a test pattern provides an output that cannot be distinguished from noise.

Further, when the test pattern is formed on ink-permeable plain paper, ink penetrates the plain paper and smudges, making obscure the test pattern. This also poses a difficulty in accurately detecting a defective nozzle in an inkjet image forming apparatus.

BRIEF SUMMARY

This patent specification describes a novel image forming apparatus that performs defective nozzle detection.

In one example, a novel image forming apparatus includes a recording head, a transfer belt, a pattern formation controller, a read unit, and a detection unit. The recording head has a plurality of nozzles aligned in a given direction, and is configured to eject droplets of a liquid from the plurality of nozzles. The transfer belt is water-repellent and is configured to convey a recording medium thereon. The pattern formation controller is configured to direct each of the plurality of nozzles to eject the liquid to form a detection pattern on the transfer belt. The detection pattern has multiple droplets ejected from each of the plurality of nozzles sequentially arranged and spaced apart from each other both in the given direction and in a direction orthogonal to the given direction. The read unit is configured to read the detection pattern to output a read result. The read unit includes a light emitting element and a light receiving element. The light emitting element is configured to illuminate the detection pattern on the transfer belt. The light receiving element is configured to receive specular light reflected from the detection pattern. The detection unit is configured to detect a defective nozzle according to the read result.

This patent specification describes a novel image forming apparatus that performs defective nozzle detection.

In one example, a novel image forming apparatus includes a recording head, a pattern formation controller, a read unit, and a detection unit. The recording head has a plurality of nozzles aligned in a given direction, and is configured to eject droplets of a liquid from the plurality of nozzles. The pattern formation controller is configured to direct each of the plurality of nozzles to eject the liquid to form a detection pattern on a water-repellent member. The detection pattern has multiple droplets ejected from each of the plurality of nozzles sequentially arranged and spaced apart from each other both in the given direction and in a direction orthogonal to the given direction. The read unit is configured to read the detection pattern to output a read result. The read unit includes a light emitting element and a light receiving element. The light emitting element is configured to illuminate the detection pattern on the water-repellent member. The light receiving element is configured to receive specular light reflected from the detection pattern. The detection unit is configured to detect a defective nozzle according to the read result.

This patent specification describes a novel method of detecting a defective nozzle in an image forming apparatus that includes a recording head having a plurality of nozzles aligned in a given direction used to eject droplets of a liquid therefrom, and a transfer belt being water-repellent and used to convey a recording medium thereon.

In one example, a novel method includes steps of pattern formation, pattern reading, and defect detection. The pattern formation directs each of the plurality of nozzles to eject the liquid to form a detection pattern on the transfer belt. The detection pattern has multiple droplets ejected from each of the plurality of nozzles sequentially arranged and spaced apart from each other both in the given direction and in a direction orthogonal to the given direction. The pattern reading reads the detection pattern to output a read result by illuminating the detection pattern on the transfer belt, and receiving specular light reflected from the detection pattern. The defect detection detects a defective nozzle according to the read result.

BRIEF DESCRIPTION OF THE DRAWINGS

A more complete appreciation of the disclosure and many of the aforementioned aspects, features and advantages will be readily obtained as the same becomes better understood by reference to the following detailed description when considered in connection with the accompanying drawings, wherein.

DETAILED DESCRIPTION OF PREFERRED EMBODIMENTS

Figure 1:
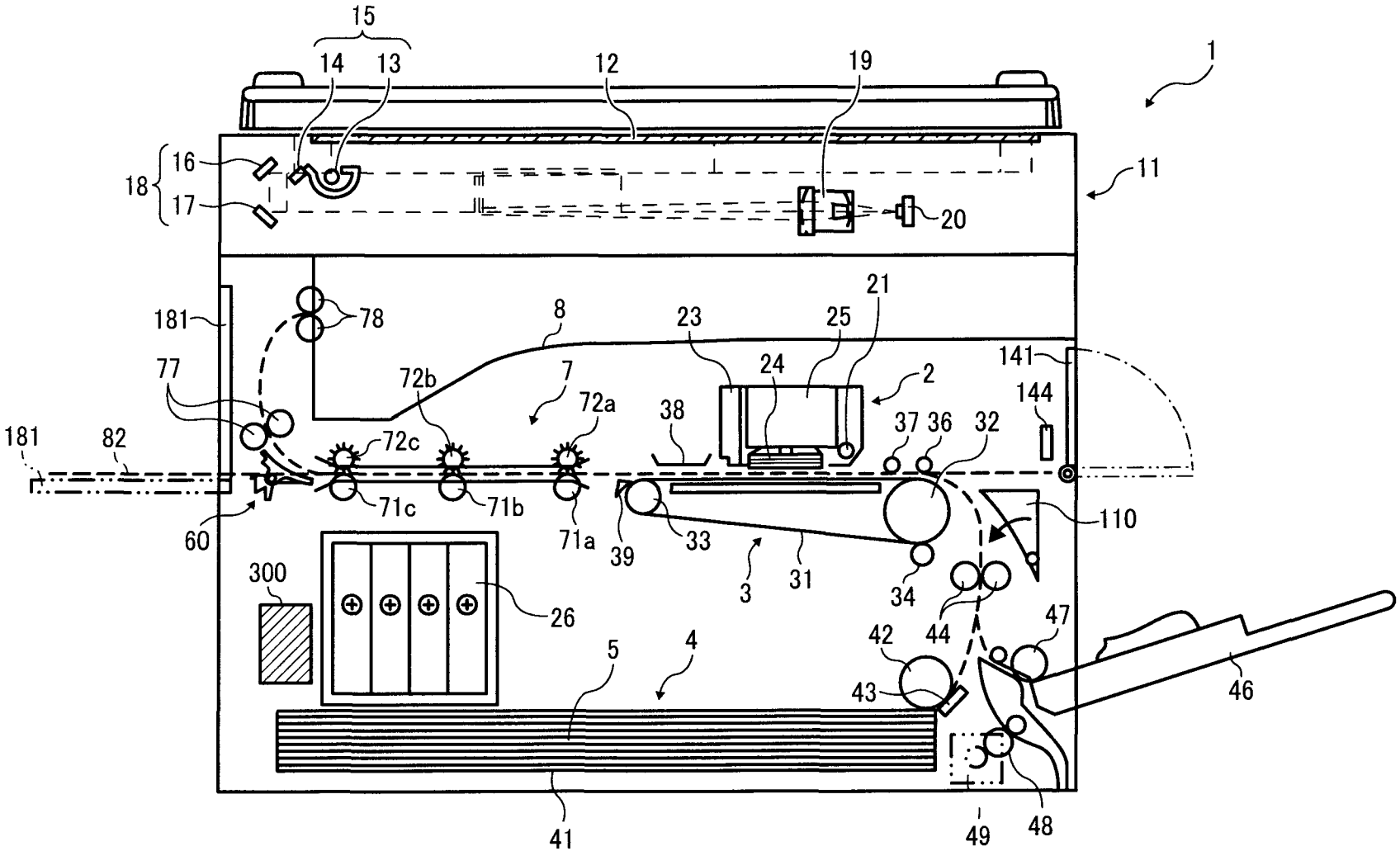
FIG. 1 is a schematic view showing an overall arrangement of an image forming apparatus according to this patent specification.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Referring now to the drawings, wherein like reference numerals designate identical or corresponding parts throughout the several views, exemplary embodiments of this disclosure are described.

An outline of an example of an image forming apparatus according to this patent specification will be explained referring to FIG. 1 to FIG. 3.

FIG. 1 is a schematic view showing an overall arrangement of an image forming apparatus 1 according to this patent specification. FIG. 2 is a plan view illustrating an image forming unit and a sub-scan transfer unit of the image forming apparatus 1. FIG. 3 is a side elevational view illustrating the image forming unit and the sub-scan transfer unit of the image forming apparatus 1, in which certain parts are shown transparent for illustrative purposes.

The image forming apparatus 1 includes an image forming unit 2 for forming an image while transferring a sheet and a sub-scan transfer unit 3 for transferring the sheet, and the like in an apparatus main body or cabinet. A sheet 5 is fed from a sheet feed cassette of a sheet feeder 4 disposed at the bottom of the apparatus main body. The image forming unit 2 forms an image on the sheets 5 by ejecting liquid droplets thereto while a sub-scan transfer unit 3 moves the sheet 5 adjacent to the image forming unit 2. Thereafter, the sheet 5 is ejected onto an ejection tray 8 formed on the upper side of the image forming apparatus 1 through a sheet transfer unit 7.

Further, the image forming apparatus includes an image read unit or scanner unit 11 disposed on the sheet tray 8 in the upper portion of the image forming apparatus 1. The image read unit 11 reads an image, serving as an input system of image data or print data to be processed by the image forming unit 2. In the image read unit 11, a scan optical system 15 including an illuminating light source 13 and a mirror 14, and a scan optical system 18 including mirrors 16 and 17 work together to read the image of an original placed on a contact glass 12. The read image is then converted to an image signal by an image read device 20 disposed behind a lens 19. The image signal is digitized and subjected to further processing to obtain print data, based on which an image is formed by the image forming unit 2.

Figure 2:
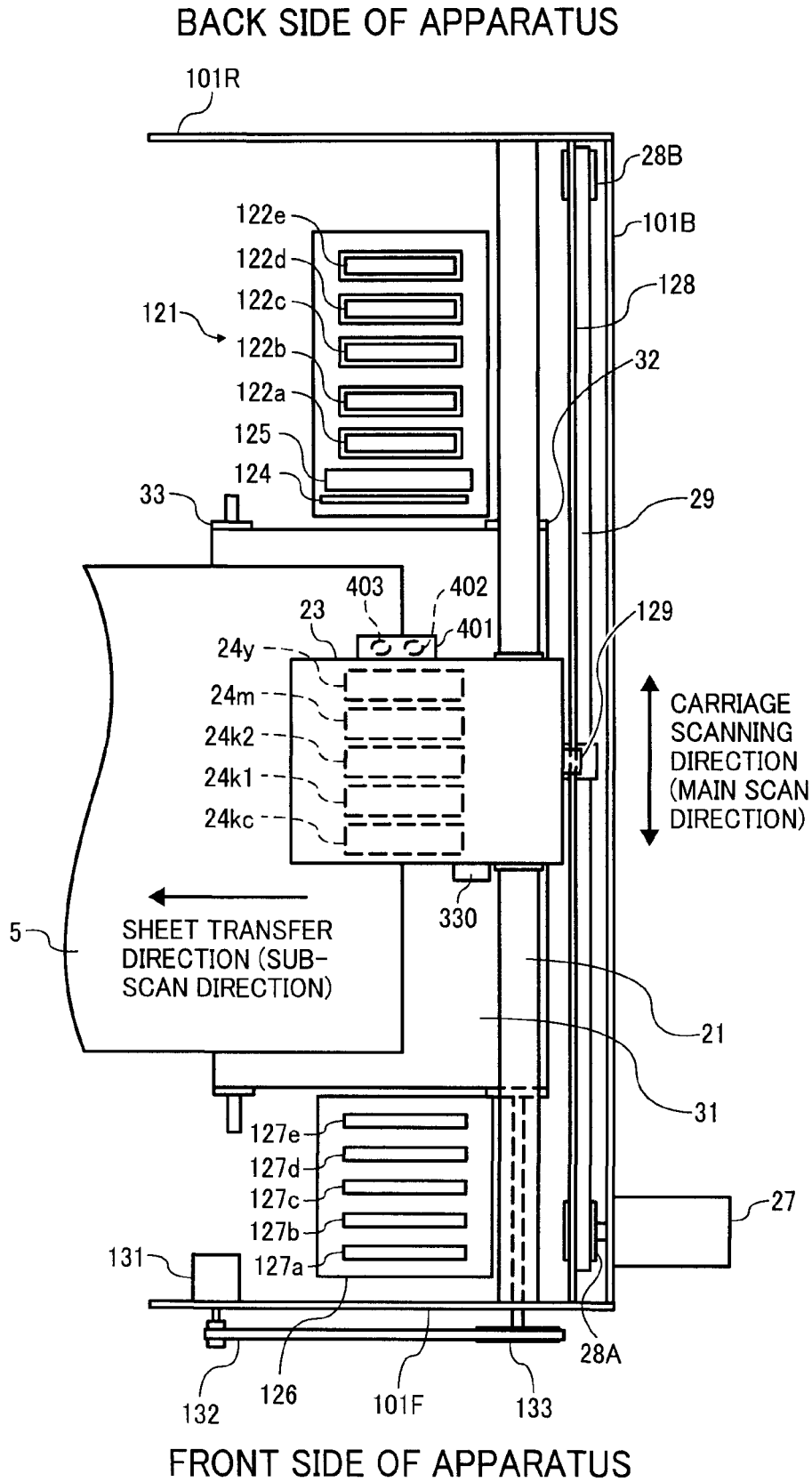
FIG. 2 is a plan view illustrating an image forming unit and a sub-scan transfer unit of the image forming apparatus.

As also shown in FIG. 2, the image forming unit 2 of the image forming apparatus 1 includes a carriage 23 held by cantilever by a guide rod 21 and a guide rail, not shown. The carriage 23 moves and scans in a main scan direction, driven by a main scan motor 27 through a timing belt 29 stretched between a driving pulley 28A and a driven pulley 28B.

As also shown in FIG. 2, the image forming unit 2 of the image forming apparatus 1 holds the carriage 23 so that it can be moved in the main scan direction by the carriage guide or guide rod 21, which is a main guide member laterally disposed between a front side plate 101F and a rear side plate 101R, and a guide stay 22, which is a guided member disposed on a rear stay 101B side and moved for scan in the main scan direction by the main scan motor 27 through the timing belt 29 stretched between the driving pulley 28A and the driven pulley 28B.

The carriage 23 also holds five liquid droplet ejection heads, including recording heads 24*k*1 and 24*k*2 composed of two liquid droplet ejection heads for ejecting black (K) ink, and recording heads 24*c*, 24*m*, and 24*y* each composed of one liquid droplet ejection head for ejecting cyan (C) ink, magenta (M) ink, and yellow (Y) ink (hereinafter generally referred to as "recording head 24"). The image forming apparatus 1 is configured as a shuttle type, where image formation is performed by moving the carriage 23 in the main scan direction and ejecting liquid droplets from the recording heads 24 while transferring the sheet 5 by the sub-scan transfer unit 3 in a sheet feed direction or sub-scan direction.

Further, the carriage 23 also has subtanks 25 mounted thereon which supply recording liquids of corresponding colors to the respective recording heads 24. As shown in FIG. 1, color ink cartridges 26, holding black (K) ink, cyan (C) ink, magenta (X) ink, and yellow (Y) ink, respectively, may be detachably mounted to a cartridge mounting portion 26A from the front side of the image forming apparatus 1 to replenish the inks or recording liquids from the color ink cartridges 26 to the respective subtanks 25 through tubing, not shown. Note that the black ink is supplied from the single ink cartridge 26 to the two subtanks 25.

The recording heads 24 may be a so-called piezo type recording head for ejecting ink droplets by changing the volume of an ink flow path or pressure generate chamber by deforming a vibration sheet that forms the wall surface of the ink flow path using a piezoelectric device as a pressure generator or actuator for pressurizing the ink in the ink flow path, a so-called thermal type recording head for ejecting ink droplets by the pressure which is generated by generating bubbles by heating ink in an ink flow path using a heat generating resistor, or an electrostatic type recording head for ejecting ink droplets by disposing a vibration sheet, which forms a wall surface of an ink flow path, and an electrode in confrontation with each other and changing the volume of the ink flow path by the electrostatic force generated between the vibration sheet and the electrode.

Further, a linear scale 128, to which a slit is formed, is interposed between the front side plate 101F and the rear side plate 101R along the main scan direction of the carriage 23. An encoder sensor 129 composed of a transmission photo sensor is disposed to the carriage 23 to detect the slit of the linear scale 128. The linear scale 128 and the encoder sensor 129A together form a linear encoder for detecting the movement of the carriage 23.

Further, a read sensor 401 is disposed on one side of the carriage 23, serving as a read unit or detection unit according to this patent specification. The read sensor 401 is configured as a reflection type photo sensor that includes a light emitting element and a light receiving element for reading a nozzle defect detection pattern. The nozzle defect detection pattern is formed on a transfer belt 31 as a water-repellent member as will be described later. An end detection sensor 330 is disposed on the other side of the carriage 23 to detect the extreme end of a recording medium being transferred.

Further, a maintenance/recovery mechanism 121 is disposed in a non-print region on one side of the carriage 23 to maintain and recover the state of the nozzles of the recording heads 24. The maintenance/recovery mechanism 121 includes a suction cap 122*a* which caps the respective nozzles surfaces 24*a* of the five recording head 24 for retaining moisture, four moisture retention caps 122*b* to 122*e*, a wiper blade 124 as a wiping member for wiping the nozzles surfaces 24*a* of the recording heads 24, and an empty ejection receiver 125 for performing empty ejection. Further, an empty ejection receiver 126 is disposed in a non-print region on the other side of the carriage 23 to perform empty ejection. Openings 127*a* to 127*e* are formed on the empty ejection receiver 126.

Figure 3:
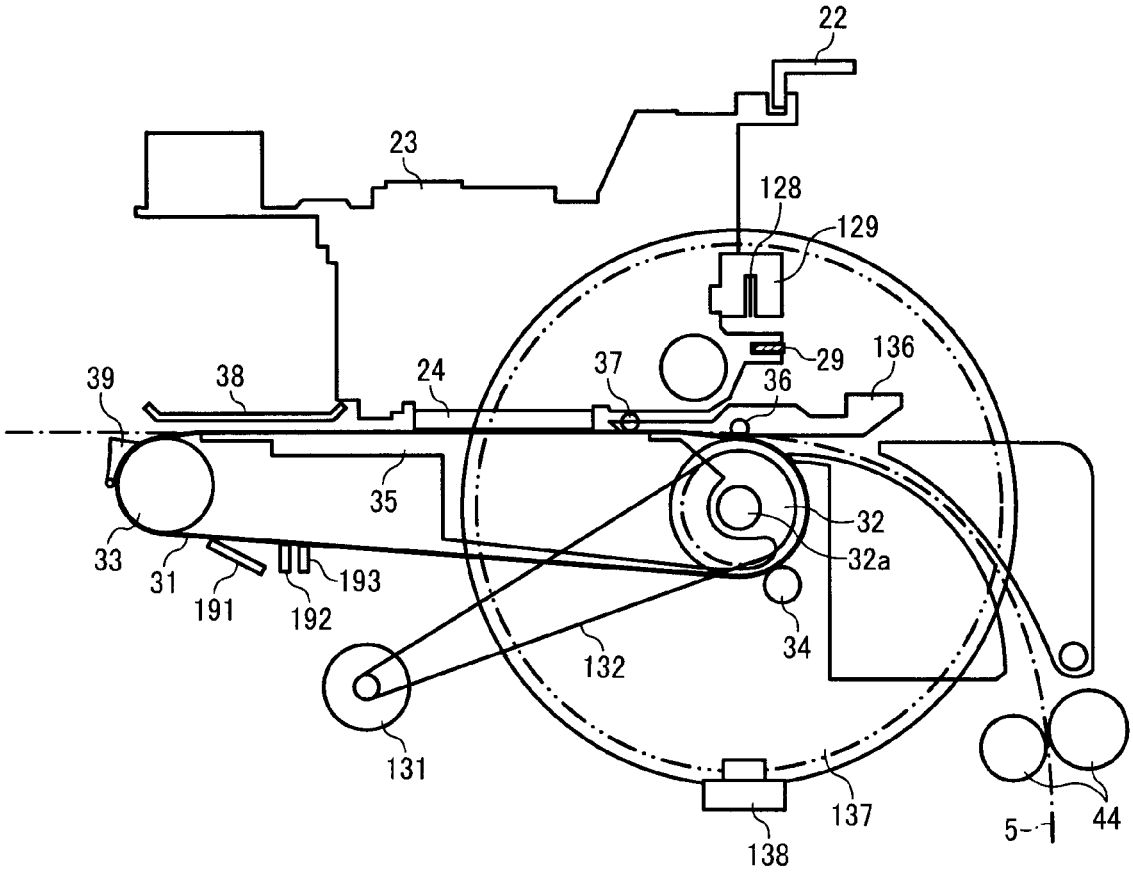
FIG. 3 is a side elevational view illustrating the image forming unit and the sub-scan transfer unit of the image forming apparatus.

As shown also in FIG. 3, the sub-scan transfer unit 3 includes an endless transfer belt 31 stretched between a transfer roller 32 being a driving roller and a driven roller 33 being a tension roller. The transfer belt 31 conveys the sheet 5 fed from a lower portion and changes orientation of the same approximately 90° so that they confront the image forming unit 2. The sub-scan transfer unit 3 also includes a charge roller 34 being a charge unit to which a high voltage as an alternating voltage is applied from a high voltage power supply to charge the surface of the transfer belt 31, a guide member 35 for guiding the transfer belt 31 in a region facing the image forming unit 2, pressure rolls 36, 37 rotatably held by a hold member 136 to press the sheets 5 against the transfer belt 31 at a position facing the transfer roller 32, a guide plate 38 for pressing the upper surface side of the sheets 5 on which the image is formed, and a separation claw 39 for separating from the transfer belt 31 the sheets 5 on which the image is formed.

The transfer belt 31 is rotated in the sheet feed direction (sub-scan direction) by driving the transfer roller 32 by a sub-scan motor 131 using a DC brushless motor through a timing belt 132 and a timing roller 133. Note that although the transfer belt 31 has a two-layered structure formed of, a surface layer serving as a sheet adsorbing surface formed of a pure resin material, for example, an ETFE pure material whose resistance is not controlled and a back layer (medium resistant layer, grounding layer) which is formed of the same material as the surface layer and whose resistance is controlled by adding carbon, the structure of the transfer belt 31 is not limited thereto and may be a single-layer structure or a structure formed of three or more layers. The surface of the transfer belt 31 (i.e., the surface on which the sheet 5 is placed) has a water-repellent property or ink-repellent property.

Further, a Mylar or paper dust remover 191, formed of a PET film abutted against the surface of the transfer belt 31, a brush-shaped cleaning brush 192 abutted against the surface of the transfer belt 31 likewise, and a diselectrification brush 193 for removing the charge of the surface of the transfer belt 31 are interposed between the driven roller 33 and the charge roller 34. These components form a cleaning unit for removing paper dust and the like deposited on the surface of the transfer belt 31. The cleaning is performed from the upstream side of the moving direction of the transfer belt 31.

Further, a high resolution code wheel 137 is disposed on a shaft 32*a* of the transfer roller 32. The code wheel 137, together with an encoder sensor 138 formed of a transmission photosensor for detecting a slit 137*a* of the code wheel 137, serves as a rotary encoder.

The sheet feeder 4 includes a sheet feed cassette 41 accommodating multiple sheets stacked thereon and detachably mounted in the image forming apparatus 1, a sheet feed roll 42 and a friction pad 43 for separating and feeding one by one the sheets in the sheet feed cassette 41, and a resist roller pair 44 for holding each fed sheet in registration.

Further, the sheet feeder 4 has a manual insertion tray 46 for accommodating multiple sheets stacked thereon, a manual insertion roll 47 for feeding one by one the sheets from the manual insertion tray 46, and a longitudinal transfer roll 48 for transferring sheets fed from a sheet feed cassette and a duplex unit which are optionally mounted on the lower side of the image forming apparatus 1. The components such as the paper feed roll 42, the resist roller pair 44, the manual insertion roll 47, the longitudinal transfer roll 48, and the like for feeding the sheets to the sub-scan transfer unit 3 are rotated by a sheet feed motor or a driver 49 being an HB type stepping motor through an electromagnetic crutch, not shown.

The sheet transfer unit 7 includes three transfer rollers 71*a*, 71*b*, and 71*c* (hereinafter generally referred to as "transfer rollers 71") for transferring the sheet 5 separated by the separation claw 39 of the sub-scan transfer unit 3, spurs 72*a*, 72*b*, and 72*c* (hereinafter generally referred to as "spurs 72") facing the transfer rollers 71*a*, 71*b*, and 71*c*, and a pair of reverse rollers 77 and a pair of ejection rollers 78 for reversing the sheet 5 and ejecting the sheet 5 to the ejection tray 8 in face down. Further, as also shown in FIG. 1, a manual sheet-insertion tray 141 is disposed on one side of the image forming apparatus 1, which can be opened and closed (pulled outward and inclined), and when a single sheet is manually inserted, the manual sheet-insertion tray 141 is pulled outward and inclined to a position indicated by a virtual line. The sheet 5 manually fed from the manual sheet-insertion tray 141 is guided along the upper surface of a guide plate 110 so as to be inserted linearly between the transfer roller 32 of the sub-scan transfer unit 3 and the a pressure roll 36.

In addition, to eject the sheet 5 having an image formed thereon face up and without bending, an ejection tray 181 is disposed on the other side of the image forming apparatus 1, which can be opened and closed (pulled outward and inclined). The sheet 5 transferred from the sheet transfer unit 7 can be ejected to the sheet tray 181 by pulling outward and turning downward the ejection tray 181.

Figure 4:
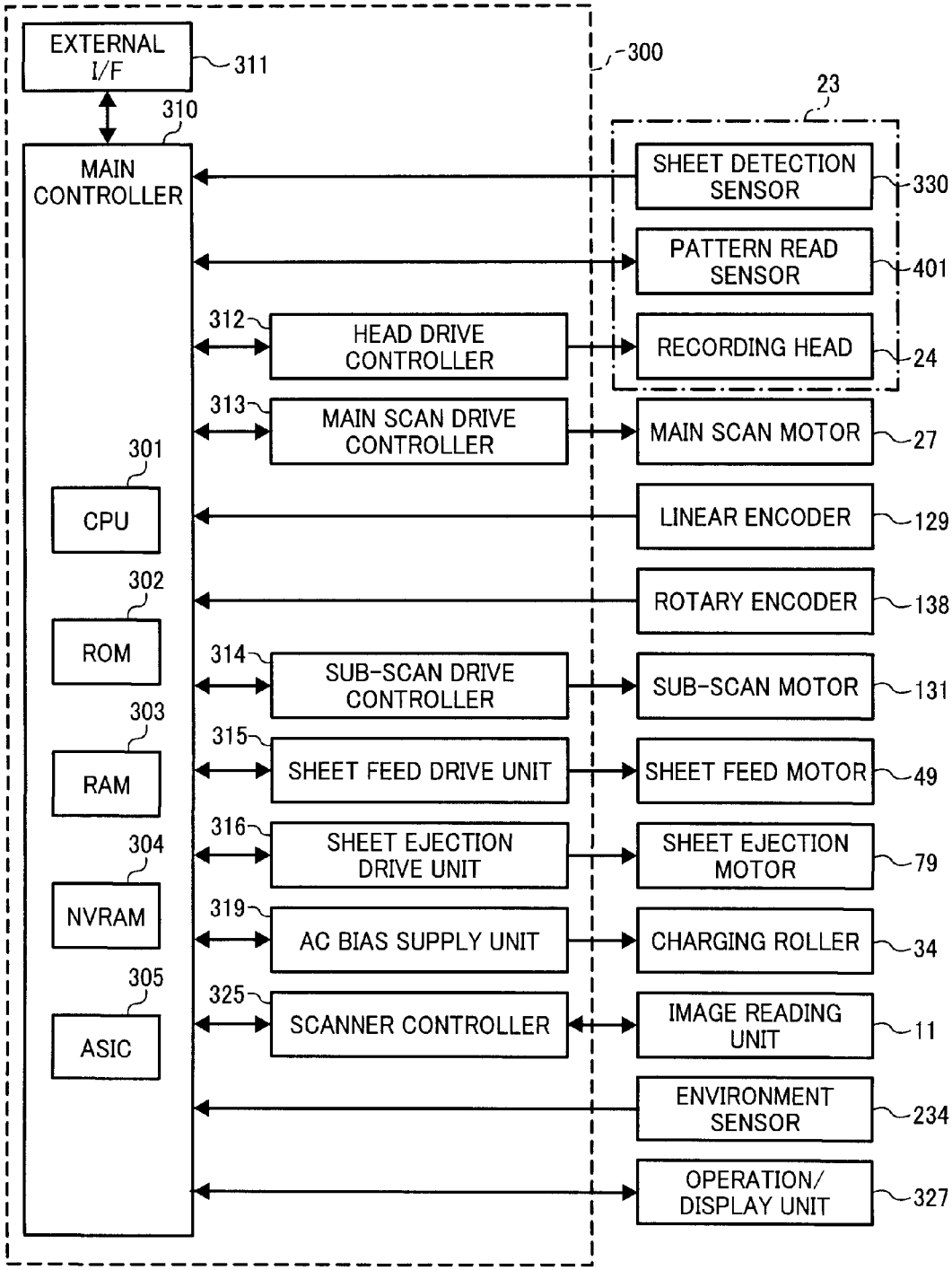
FIG. 4 is a block diagram illustrating an outline of a controller of the image forming apparatus.

Next, an outline of a controller 300 of the image forming apparatus will be explained referring to a block diagram of FIG. 4.

The controller 300 includes a main controller 310 for controlling the apparatus in its entirety, which includes a CPU 301, a ROM 302 for storing programs executed by the CPU 301 and other fixed data, a RAM 303 for temporarily storing image data and the like, a non-volatile memory (NVRAM) 304 for holding data during a period in which a power supply of the apparatus is shut off, and an ASIC 305 for performing various signal processing on image data, rearrangement of image data, and processing of input and output signals for controlling the apparatus in its entirety. The main controller 310 controls formation and reading of a detection pattern according to this patent specification as well as detection or detection of a defective nozzle using such a detection pattern.

Further, the controller 300 includes an external I/F 311 connecting a host to the main controller 310 for transmitting and receiving and data and signals, and a head drive controller 312 for controlling the drive of the recording heads 24. The head drive controller 312 has a head driver formed by a head data creation/disposition converting ASIC and the like, which is practically disposed in the recording head 24. The controller 300 also includes a main scan drive unit or motor driver 313 for driving the main scan motor 27 to move the carriage 23 in scanning, a sub-scan drive unit or motor driver 314 for driving the sub-scan motor 131, a sheet feed drive unit 315 for driving the sheet feed motor 49, a sheet ejection drive unit 316 for driving a sheet ejection motor 79 to rotate the rollers of the sheet transfer unit 7, and an AC bias supply unit 319 for supplying an AC bias to the charge roller 34. Although not shown in the drawing, the controller 300 also includes a recovery system drive unit for driving a maintenance/recovery motor to operate the maintenance/recovery mechanism 121, a duplex drive unit for driving the duplex unit, a solenoids drive unit for driving various solenoids (SOL), and a crutch drive unit for driving electromagnetic crutches and the like. The controller 300 further includes a scanner controller 325 for controlling the image reading unit 11.

In addition, the main controller 310 receives various detection signals from an environment sensor 234 and the like for detecting the temperature and the humidity (environment conditions) in the periphery of the transfer belt 31. Note that the main controller 310 also receives signals from other sensors, the illustration of which is omitted for brevity. Further, the main controller 310 communicates with an operation/display unit 327 of the image forming apparatus 1 including various types of keys such as ten keys, a print start key, and the like, as well as display devices for user operation. The operation/display unit 327 transmits user inputs to the main controller 327, and displays information output from the main controller 327.

The main controller 310 also receives a signal output from the photosensor or encoder sensor 129 forming the linear encoder for detecting the carriage position described above. The main controller 310 controls the sub-scan motor 27 through the main scan drive unit 315 based on the output signal, thereby moving back and forth the carriage 23 along the main scan direction. Further, the main controller 310 receives a pulse signal output from the photosensor or encoder sensor 138 forming the rotary encoder for detecting the amount of movement of the transfer belt 31 described above. The main controller 310 moves the transfer belt 31 through the transfer roller 32 by controlling the sub-scan motor 131 through the sub-scan drive unit 314 based on the output signal.

Further, the main controller 310 controls formation of a detection pattern on the transfer belt 31, light emission by the light emitting element of the read sensor 401 mounted on the carriage 23, and reading of the detection pattern based on an output from the light receiving element. The main controller 310 serves to detect a defective nozzle from a result of the reading, and control a maintenance/recovery operation performed on the recording head 24 upon detection of a nozzle defect, as will be described later in more detail.

An image forming operation of the image forming apparatus 1 will be briefly described hereinbelow. First, the amount of rotation of the transfer roller 32 driving the transfer belt 31 is detected, and the sub-scan motor 131 is controlled based on the detected amount of rotation. The AC bias supply unit 319 supplies a rectangular wave, high alternating voltage to the charge roller 34, thus forming bands of positive and negative charges in alternate sequence on the transfer belt 31 along the transfer direction of the transfer belt 31. This creates a non-uniform electric field on the transfer belt 31 with charges having a given charge width.

Then, the sheet feed unit 4 feeds the sheet 5 to between the transfer roller 32 and the first pressure roll 36, which is advanced onto the transfer belt 31 on which the non-uniform electric field is created. When deposited on the transfer belt 31, the sheet 5 is instantly polarized according to the electric field to be attracted to the transfer belt 31, and conveyed thereon with the movement of the transfer belt 31.

The transfer belt 31 moves the sheet 5 intermittently, onto which the recording heads 24 eject droplets of recording liquid with the carriage 23 moving in the main scan direction to form or print an image. The sheet 5 having an image printed thereon is sent to the sheet transfer unit 7 with the separation claw 39 separating the sheet end from the transfer belt 31, which ejects the sheet 5 to the ejection tray 8.

Figure 5:
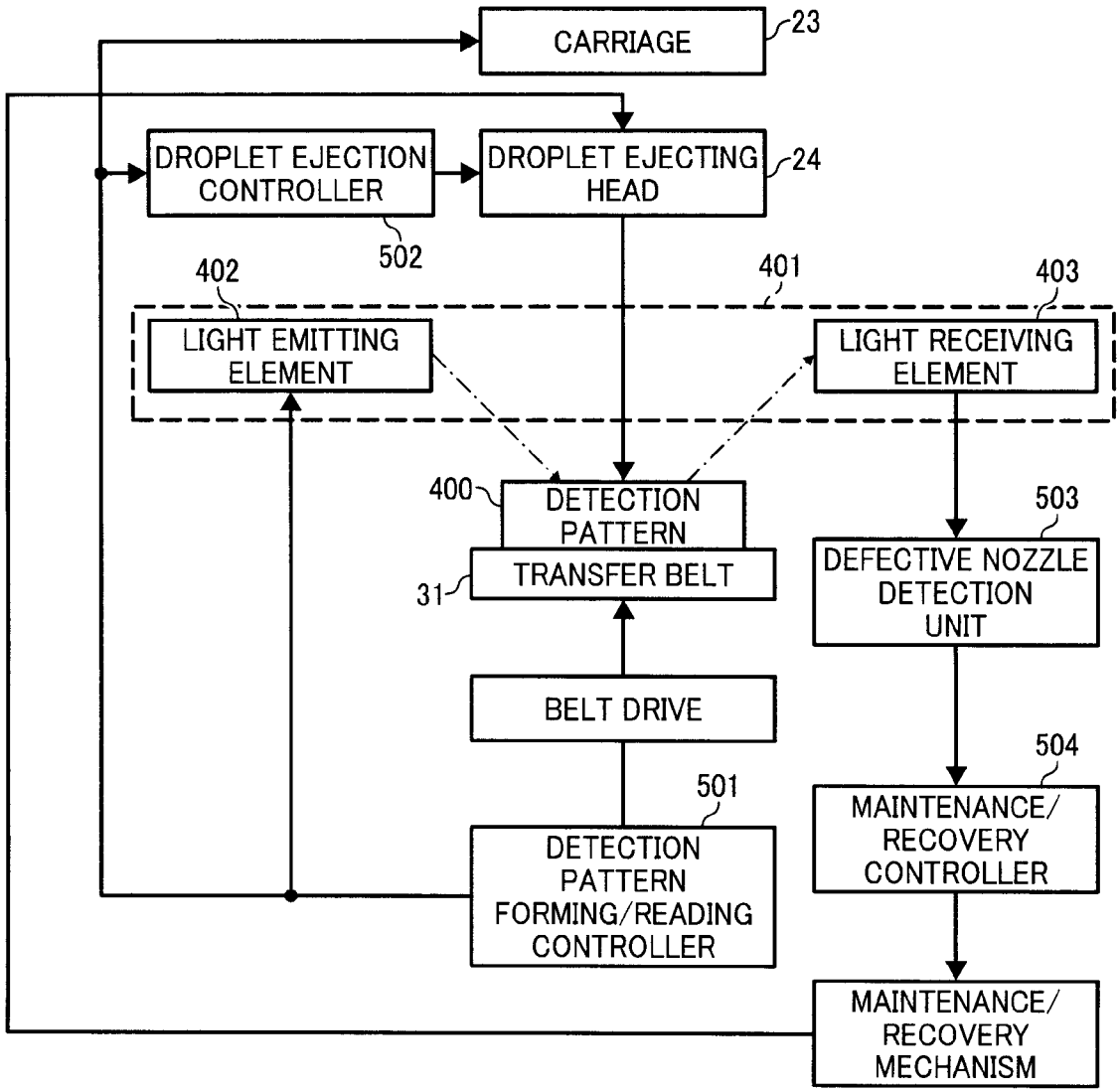
FIG. 5 is a functional block diagram illustrating portions of the image forming apparatus relating to formation, reading, and detection of a nozzle defect detection pattern according to an embodiment of this patent specification.
Figure 6:
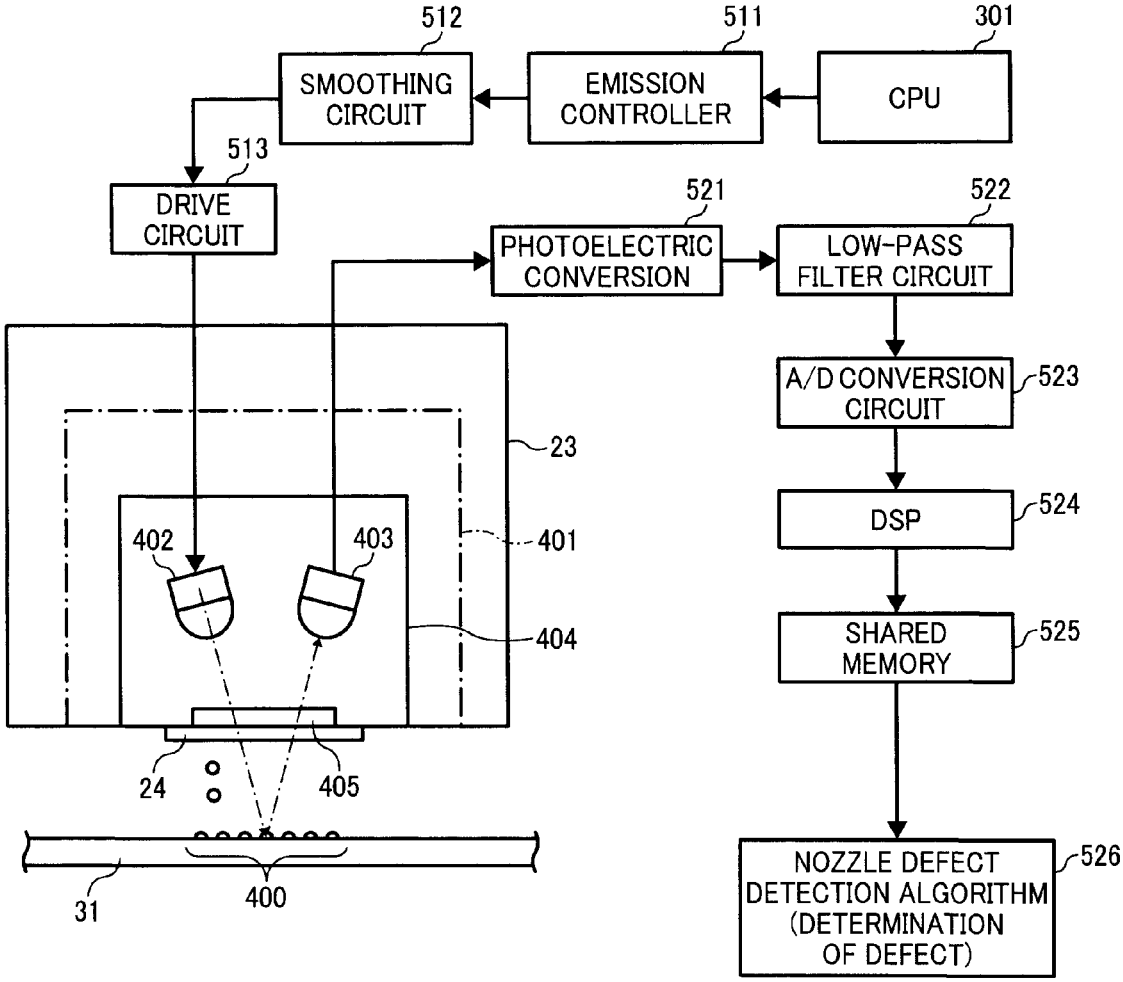
FIG. 6 is a schematic diagram showing the portions depicted in FIG. 5.
Figure 7:
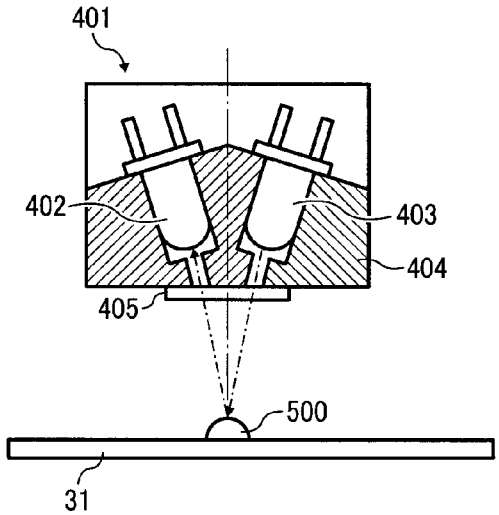
FIG. 7 is a schematic diagram illustrating a read sensor used in the image forming apparatus.

In addition, when in standby, the carriage 23 is moved to the maintenance/recovery mechanism 121, which caps the nozzles of the recording head 24 with the cap 122 to prevent defective ejection due to dried ink by keeping the nozzles in a humid state. Further, the maintenance/recovery mechanism 121 reconditions the recording head 24 by sucking ink from the nozzles capped with the suction cap 122*a* and removing thickened ink or bubbles trapped in ink. Thereafter, a wiper blade 124 wipes the recording head 24 to clean and remove ink, deposited on the nozzles by the recovery operation. Further, the recording head 24 performs an empty ejection before and during a recording operation, where ink is ejected to the empty ejection receiver 125 and is not used for recording. Such operation secures stable ejection performance of the recording head 24. Next, portions relating to the nozzle defect detection control in the image forming apparatus 1 will be explained referring to FIGS. 5 and 6. FIG. 5 is a functional block diagram illustrating portions of the image forming apparatus 1 relating to formation, reading, and detection of a nozzle defect detection pattern according to an embodiment of this patent specification, and FIG. 6 is a schematic diagram showing the portions depicted in FIG. 5. As shown in FIGS. 5 and 6, the carriage 23 includes the read sensor 401 for detecting a detection pattern 400 formed on the transfer belt 31 which is water-repellant, as will be described later with reference to FIG. 7. The read sensor 401 includes a light emitting element 402 for illuminating the detection pattern 400 on the water-repellant transfer belt 31, and a light receiving element 403 for receiving specular light reflected from the detection pattern 400. The light emitting element 402 and the light receiving element 403 are packaged in a holder 404, with a lens 405 disposed where light emerges from and coming into the holder 404.

Note that the light emitting element 402 and the light receiving element 403 in the reading sensor 401 are disposed in a direction orthogonal to the scan direction of the carriage 23 (see FIG. 2). This arrangement reduces an influence of variations in moving speed of the carriage 23 on the result of detection. The light emitting element 402*a* may be a relatively simple and less expensive light source such as LED and the like using an infrared and/or visible light. The lens used in such an optical system does not require high accuracy and therefore less expensive with a spot diameter of the light source (detecting range, detecting region) is in an order of millimeters.

When performing defective nozzle detection, a detection pattern forming/reading controller 501 moves the carriage 23 for scanning in the main scan direction along the transfer belt 31 as well as direct an liquid droplet ejection controller 502 to cause the recording head 24 to eject liquid droplets. This generates the detection pattern 400 formed of a plurality of liquid droplets 500 spaced apart from each other. Note that the detection pattern forming/reading controller 501 may be configured by the CPU 301 of the main controller 310. Further, the detection pattern forming/reading controller 501 controls the read sensor 401 to read the detection pattern 400 formed on the transfer belt 31. In reading the detection pattern 400, the read sensor 401 causes the light emitting element 402 to emit light while the carriage 23 moves in the main scan direction. Specifically, as shown in FIG. 6, a light emission controller 511 outputs a signal for driving the light emitting element 402 according to a PWM value given by the CPU 301. The driving signal is smoothed by the smoothing circuit 512 and transmitted to the drive circuit 513, which accordingly drives the light emitting element 402 to emit light to the detection pattern 400 on the transfer belt 31.

The light emitted by the light emitting element 402 is reflected by the detection pattern 400 to enter the read sensor 401, where the light receiving element 403 receives a specular component of the reflected light to output a detection signal indicating the amount of specular light reflected from the detection pattern 400. The detection signal is transmitted to a defective nozzle detection unit 503. Specifically, as shown in FIG. 6, the signal output from the light receiving element 403 is subjected to photoelectric conversion by a photoelectric conversion circuit 521 included in the main controller 310 (not shown in FIG. 5). The photoelectrically converted signal or sensor output voltage is subjected to noise removal by a low path filter circuit 522, then to A/D conversion by an A/D conversion circuit 523, and the data of A/D converted sensor output voltage is stored to a shared memory 525 by a signal processing circuit (DSP) 524.

The defective nozzle detection unit 503 determines whether a defective nozzles is present or not based on the output from the light receiving element 403 of the read sensor 401, which represents the detection pattern 400. When the defective nozzle detection unit 503 detects presence of a defective nozzle, the maintenance/recovery mechanism 121 performs the maintenance/recovery operation on the recording head 24 as described above.

The detection pattern 400 in this patent specification will be explained hereinbelow.

Figure 8:
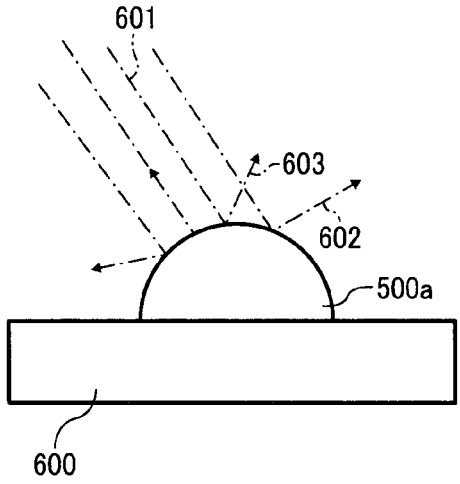
FIG. 8 is an explanatory view showing reflection of light by a liquid droplet.
Figure 9:
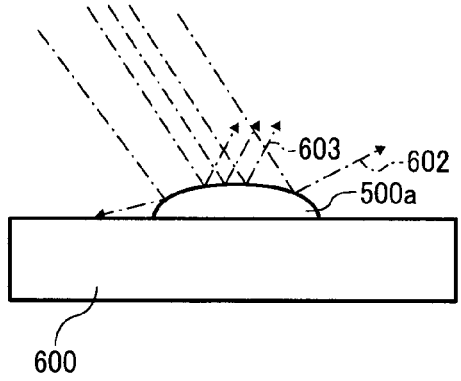
FIG. 9 is an explanatory view showing reflection of light by a liquid droplet having a flat surface.

Referring to FIGS. 8 and 9, how the light is reflected by a liquid droplet (hereinafter referred to as "ink droplet") is illustrated for better understanding a principle of the detection pattern according to this patent specification.

As shown in FIG. 8, an ink droplet 500*a* deposited on a receiving member 600 has a substantially hemispherical, shiny surface. When incident light 601 impinges on the droplet surface, the reflected light includes a major amount of diffused light 602 and a minor amount of specular light 603.

Figure 10:
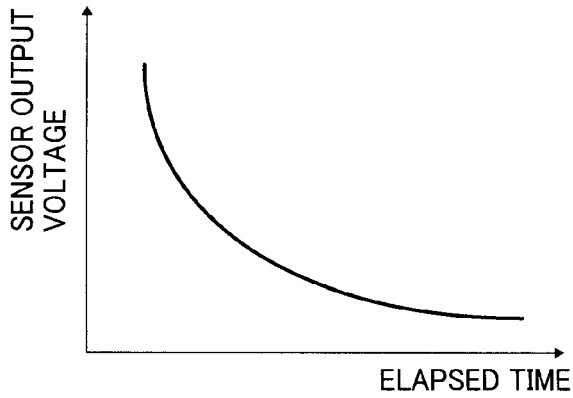
FIG. 10 is a plot showing a voltage output from the read sensor varying with time.

As time passes, the liquid droplet 500*a* dries to lose shine and become flat in shape as shown in FIG. 9. As a result, the area in the droplet surface where the light is specularly reflected increases, and consequently, the ratio of specular components to diffused components included in the reflected light increases. FIG. 10 is a plot showing a voltage output from the read sensor 403 detecting the specular light 603, which decreases with time so as to reduce accuracy in detection of the detection pattern 400 as will be described later.

Figure 11:
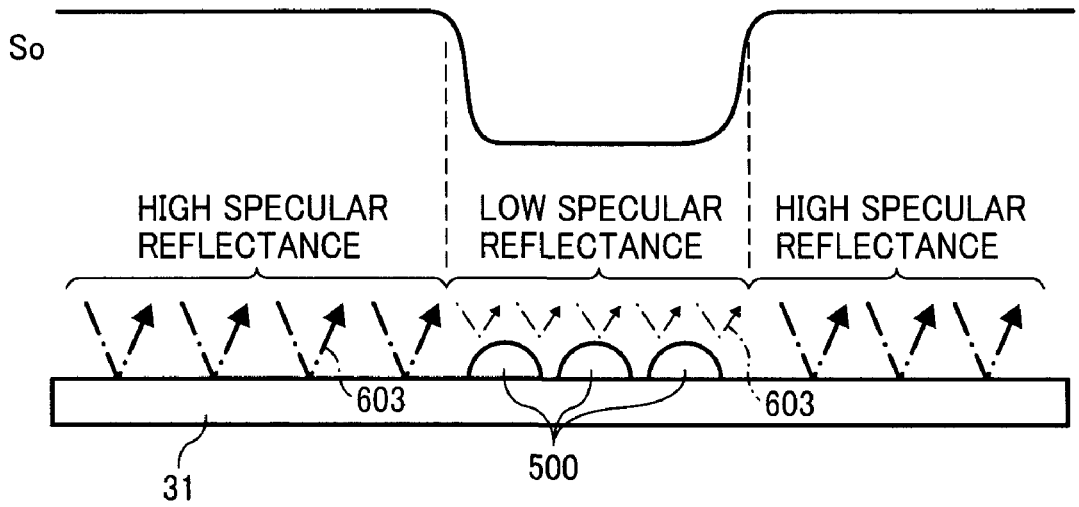
FIG. 11 is a schematic diagram illustrating detection of droplets forming the detection pattern according to this patent specification.

Referring to FIG. 11, a schematic diagram illustrating detection of the detection pattern according to this patent specification is described.

As shown in FIG. 11, the transfer belt 31 has a shiny surface which reflects specular light when illuminated by the light emitting device 401. Accordingly, the read sensor 403 outputs the sensor output So relatively high when sensing an area of the transfer belt 31 which does not have an ink droplet disposed thereon, and therefore reflects a larger amount of specular light 603.

By contrast, the read sensor 403 outputs the sensor output So relatively low when sensing an area of the transfer belt 31 which has a plurality of ink droplets 500 with a hemispherical shiny surface, each reflecting a small amount of specular light 603.

According to this patent specification, it is preferable that the multiple droplets 500 forming the detection pattern 400 reflect light containing a constant ratio of diffused light, that is, the detection pattern 400 scatters light uniformly where the droplets 500 are present. This secures high reproducibility of the sensor output So, achieving precise detection of the detection pattern 400 according to this patent specification. In order that the droplets 500 forming the detection pattern 400 reflect light containing a constant ratio of diffused light, it is desirable to form the multiple droplets 500 sequentially arranged and spaced apart from each other, so that each of the droplets 500 contacts the transfer belt 31 with a constant contact surface area.

Figure 12:
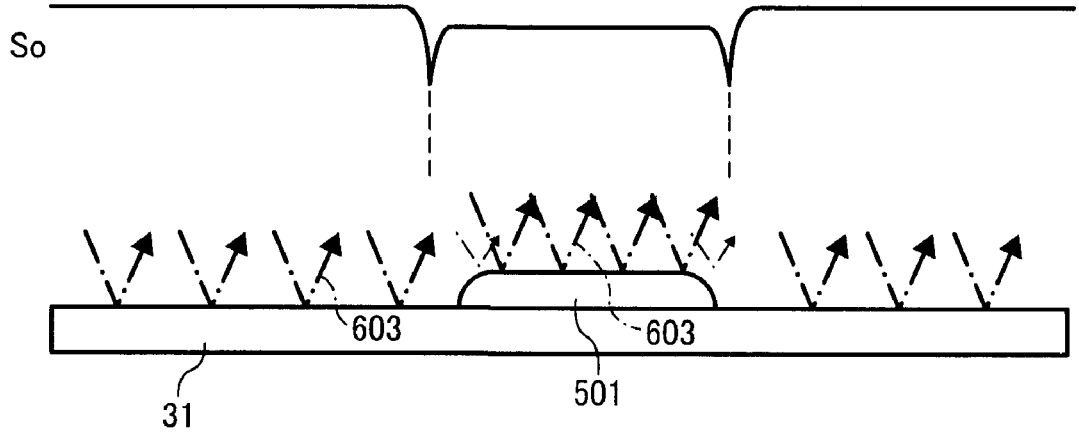
FIG. 12 is a schematic diagram illustrating detection of a droplet.

For comparison purposes, consider a case where droplets ejected collect to form a single droplet 501 on the transfer belt 31 with reference to FIG. 12. As the droplet 501 has a relatively flat surface and reflects light with a relatively large amount of specular light 603. As a result, the read sensor 403 outputs the sensor output So relatively high when sensing the surface of the droplet 501, which is hardly distinguished from the output indicating the area not having a droplet disposed thereon, making difficult the detection of the droplet 501. It is noted that an edge portion of the ink droplet 501 may have a relatively low specular reflectance. Since such a portion is a significantly small part of the entire surface of the droplet 501, detecting the droplet 501 by identifying the droplet edge is not desirable, since it requires detection of a region to be scanned by the read sensor 401, and can be affected by noise resulting from tiny scratches and dusts on the transfer belt 31, leading to a reduction in detection accuracy and reliability.

Accordingly, it is preferable to detect the presence of an ink droplet according to an output from the read sensor 401 which indicates a reduction in specular light in the light reflected from the detection pattern 400. To achieve high precision in the pattern detection, it is desired that the detection pattern 400 have a portion to be scanned by the read sensor 401 formed of droplets sequentially arranged and spaced apart from each other. Such a configuration allows high precision in detecting the presence of droplets using the relatively simple mechanism formed of a light emitting element and light receiving element.

As mentioned in above, since an ink droplet dries to change reflectance (see FIG. 10), it is also preferable that the read sensor 401 read the detection pattern 400 when a given time has elapsed since the detection pattern 400 is formed, so as to ensure reliability of the pattern detection according to this patent specification.

Figure 13:
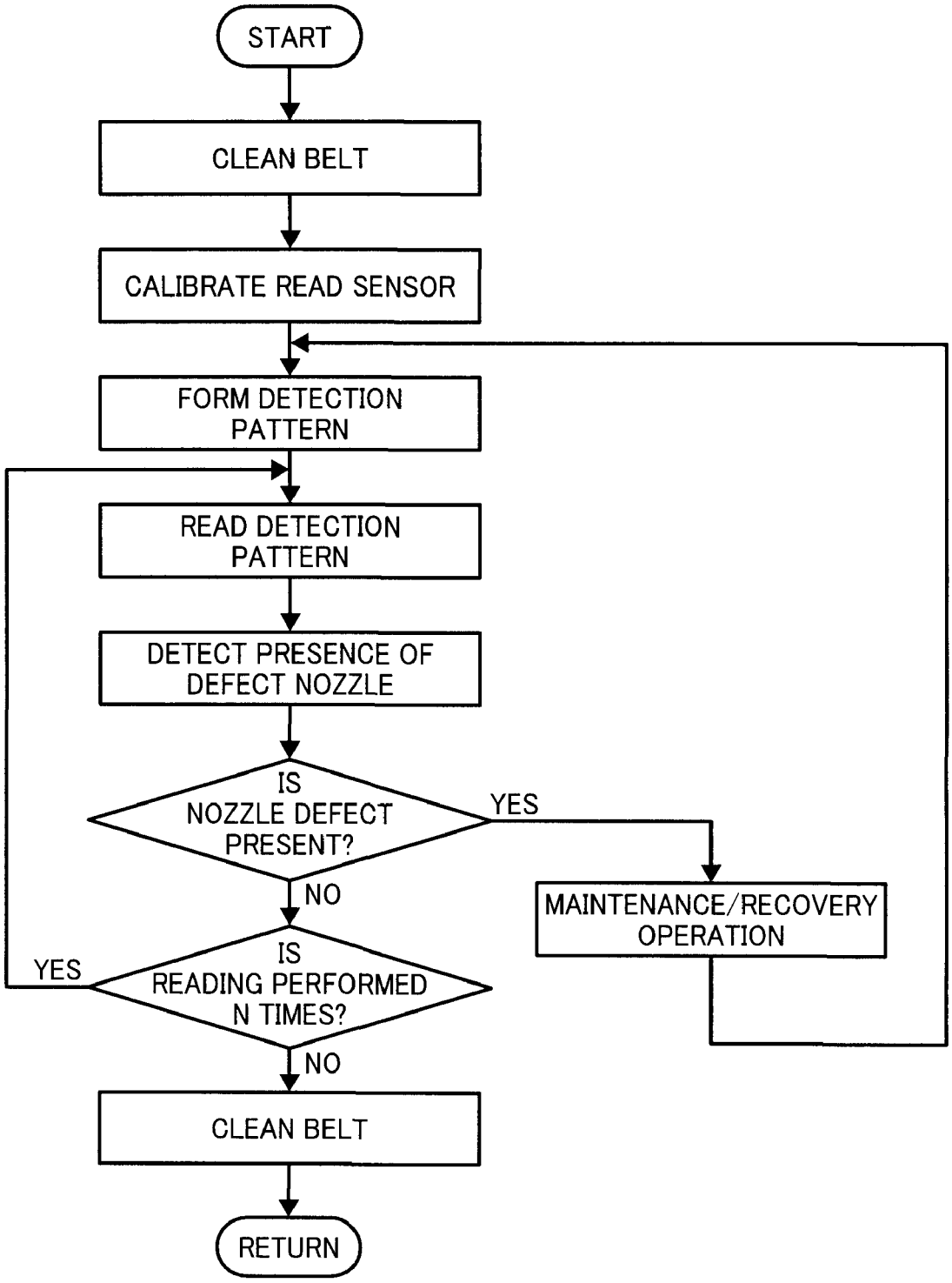
FIG. 13 is a flowchart illustrating an example of nozzle defect detection performed by the image forming apparatus according to this patent specification.

Referring now to FIG. 13, a flowchart illustrating formation, reading, and detection of the detection pattern 400 in the image forming apparatus 1 according to this patent specification is described.

First, preprocessing is performed by cleaning the transfer belt 31 and calibrating the read sensor 401. In the sensor calibration, the output level of the light emitting element 402 is adjusted so that the read sensor 401 output a constant voltage when scanning the cleaned surface of the transfer belt 31.

Then, the carriage 23 moves in the main scan direction with the recording head 24 ejecting liquid droplets to form the detection pattern 400. After the pattern formation, the carriage 23 moves in the main scan direction to a given position corresponding to the detection pattern 400, and the transfer belt 31 moves in the sub-scan direction. At the same time, the light emitting element 402 emits light and the light receiving element 403 senses light reflected from the detection pattern 400, so that the read sensor 400 outputs a sensor or read output, based on which the presence of a defective nozzle is detected.

When there is no nozzle defect detected, the detection process may be repeated multiple times with the carriage 23 moving to different positions along the main scan direction, in which case the detection ends when the same process is repeated N times without detecting a defective nozzle.

When a defective nozzle is detected, the maintenance/recovery mechanism 121 performs the recovery of the recording head 24 as described above, and the detection process is performed again. Alternatively, the operation ends without again performing the detection process so as to save time required to perform the defect detection.

After the detection process, the transfer belt 31 is cleaned to end the entire operation.

Referring now to FIGS. 14 through 17, the formation of the detection pattern 400 according to this patent specification is described hereinbelow.

Figure 14:
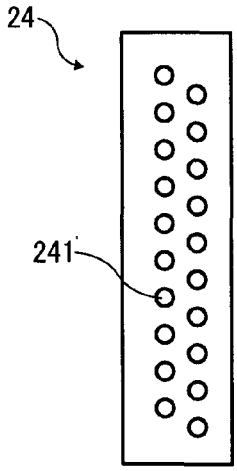
FIG. 14 is a schematic view illustrating an example of nozzle disposition in a recording head.

FIG. 14 is a schematic view illustrating an example of nozzle disposition in the recording head 24. The recording head 24 includes first through n-th nozzles 241 staggered in two rows (hereinafter referred to as "nozzle rows").

Figure 15:
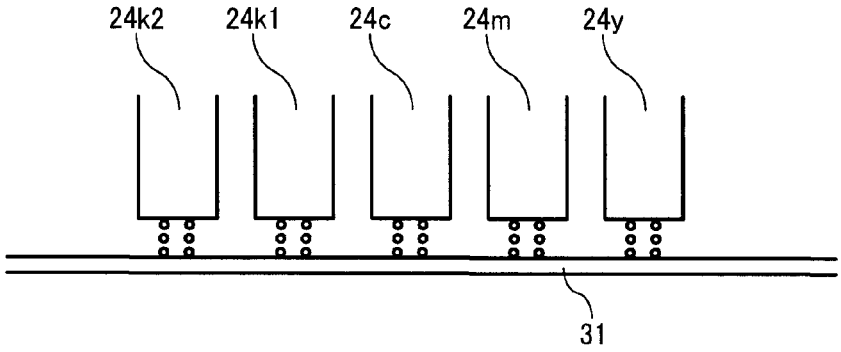
FIG. 15 is a schematic view illustrating droplet ejection by the recording head of FIG. 14.
Figure 16:
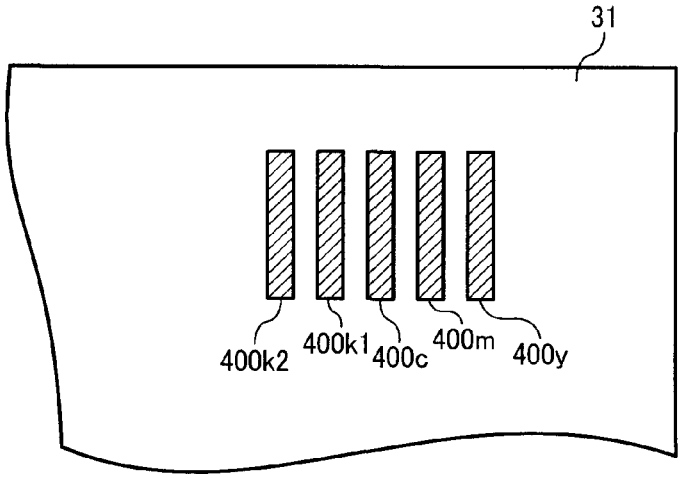
FIG. 16 is a schematic view illustrating the detection pattern formed by the recording head of FIG. 14.

As shown in FIG. 15, in forming the detection pattern 400, the carriage 23 having the recording heads 24*k*2, 24*k*1, 24*c*, 24*m*, and 24*y* moves to the given position in the main scan direction with the n nozzles in each recording head ejecting droplets to the transfer belt 31. Such ejecting operation may be performed simultaneously or sequentially for each of the recording heads 24*k*2, 24*k*1, 24*c*, 24*m*, and 24*y*. The ejecting operation forms detection patterns 400*k*2, 400*k*1, 400*c*, 400*m*, and 400*y* on the transfer belt 31 as shown in FIG. 16.

Figure 17:
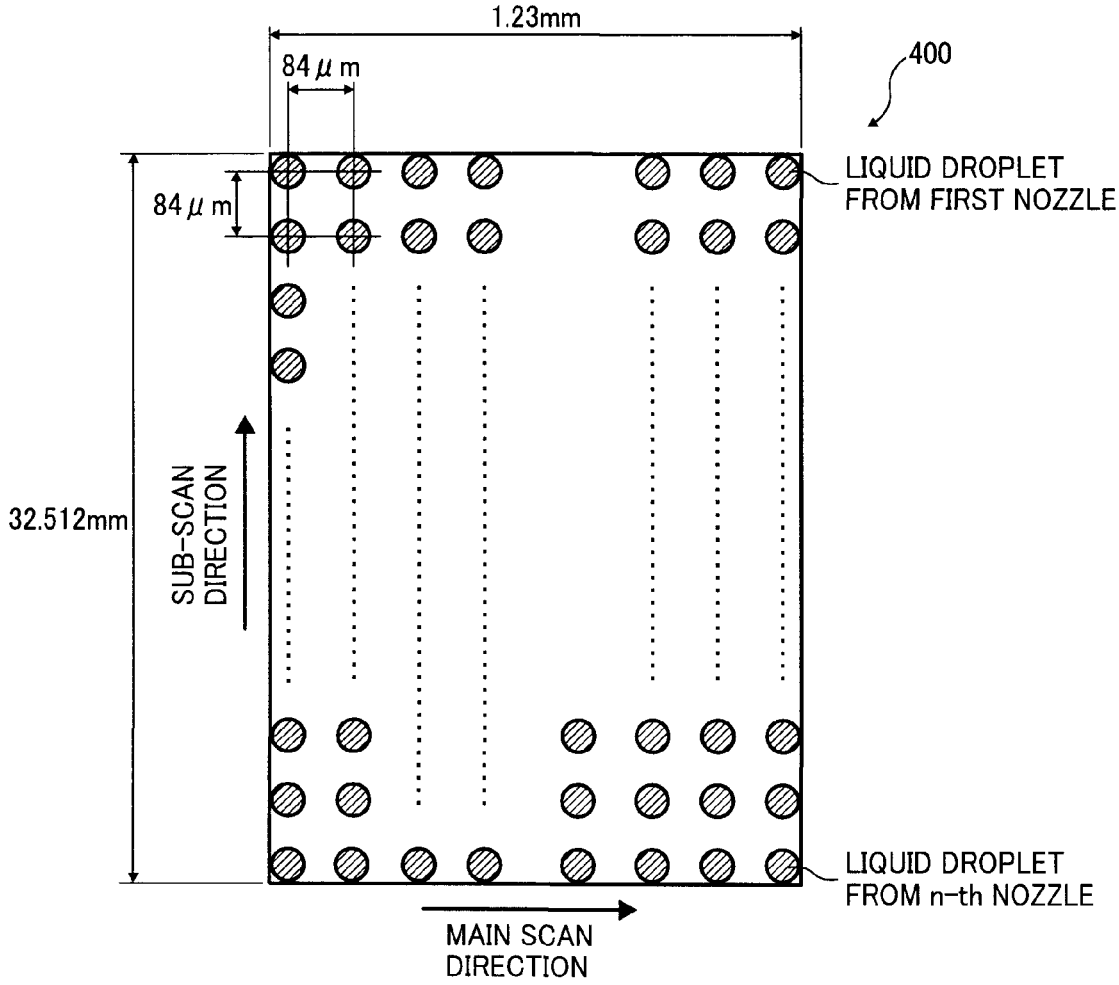
FIG. 17 is a schematic diagram illustrating formation of the detection pattern according to one embodiment of this patent specification.

FIG. 17 is a schematic diagram illustrating the detection pattern 400 according to one embodiment of this patent specification. It is to be noted that the detection pattern 400 includes multiple droplets sequentially arranged and spaced apart from each other, and has a length greater than a spot diameter of light emitted by the light emitting element 402 in the main scan direction. For example, for a sensor spot diameter of 1 millimeter, the detection pattern 400 may have a length of 1.23 millimeters in the main scan direction, which corresponds to 15 droplets in series with an assumed resolution of 300 dpi. The length of the detection pattern 400 in the sub-scan direction is determined by the dimension of the recording head, for example, with a recording head having 384 nozzles, the detection pattern 400 may have a length of 32.512 millimeters in the sub-scan direction.

Figure 18:
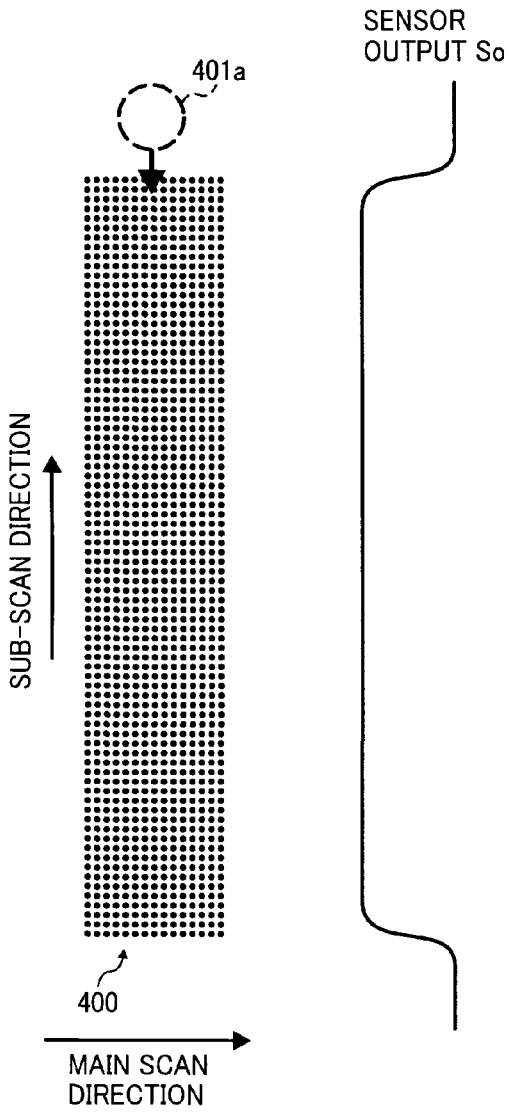
FIG. 18 is a schematic diagram illustrating reading of the detection pattern according to the embodiment of FIG. 17 together with a corresponding sensor output, wherein there is no defective nozzle detected.
Figure 19:
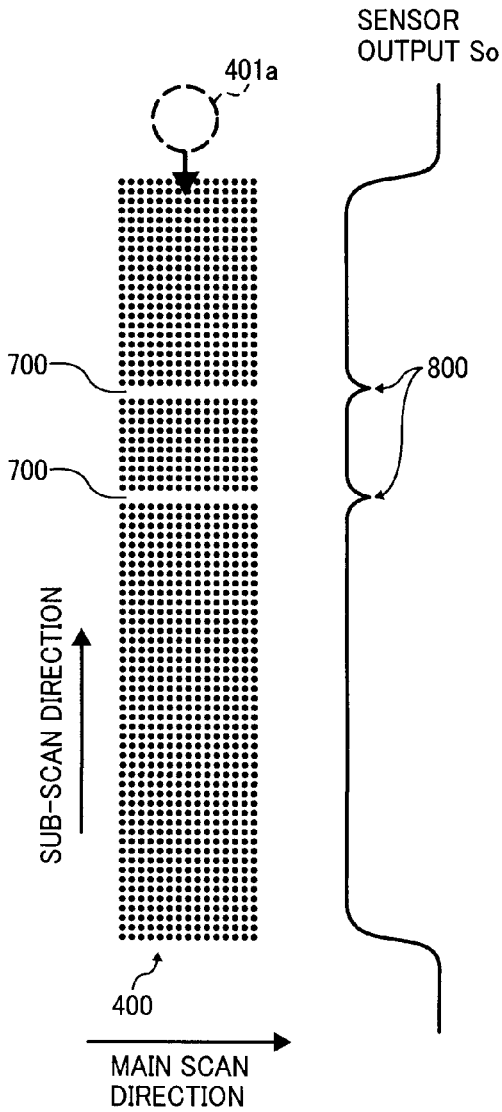
FIG. 19 is another schematic diagram illustrating reading of the detection pattern according to the embodiment of FIG. 17 together with a corresponding sensor output, wherein there are defective nozzles detected.

Referring now to FIGS. 18 and 19, reading of the detection pattern 400 according one embodiment to this patent specification is described. In FIGS. 18 and 19, the detection pattern 400 is depicted with a horizontal direction corresponding to the main scan direction and a vertical direction corresponding to the sub-scan direction.

As shown in FIG. 18, when every nozzle in the recording head 24 does not suffer a defect and properly operates, the detection pattern 400 formed by the recording head 24 includes multiple droplets sequentially arranged and spaced apart from each other in a complete matrix. In scanning the detection pattern 400, the sensor spot 401*a* moves in the sub-scan direction as the transfer belt 31 moves with respect to the read sensor 401. The sensor output So of the read sensor 401 is uniformly low over a range corresponding to the upper and lower ends of the detection pattern 400 in the case of FIG. 18, indicating there is no nozzle defect.

As shown in FIG. 19, when there are defective nozzles in the recording head 24, the detection pattern 400 formed by the recording head 24 includes multiple droplets sequentially arranged in a matrix with some blank portions 700 corresponding to the defective nozzles appearing parallel to the main scan direction. In scanning the detection pattern 400, the sensor spot 401*a* moves in the sub-scan direction as the transfer belt 31 moves with respect to the read sensor 401. The sensor output So of the read sensor 401 is generally low with irregularities or prominences 800 corresponding to the blank portions 700 over a range corresponding to the upper and lower ends of the detection pattern 400 in the case of FIG. 19, indicating the presence of nozzle defects.

Figure 20A:
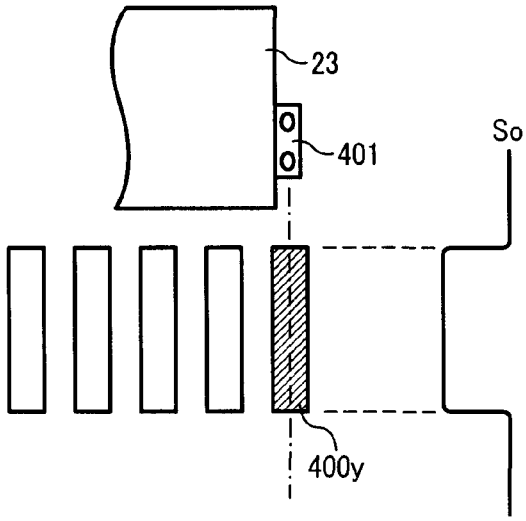
FIGS. 20A through 20C are explanatory views illustrating reading of the detection pattern performed by a read sensor according this patent specification.
Figure 20B:
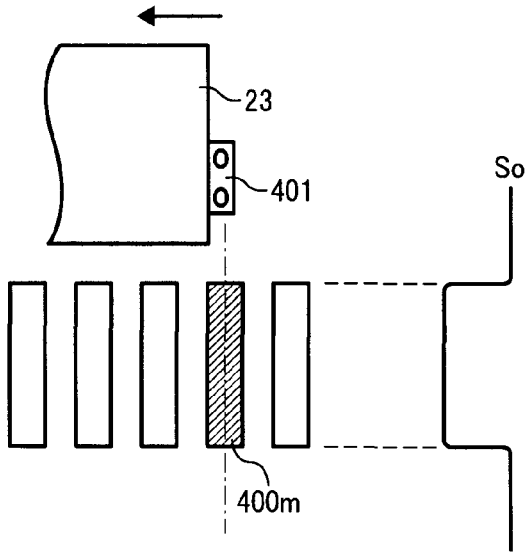
Figure 20C:
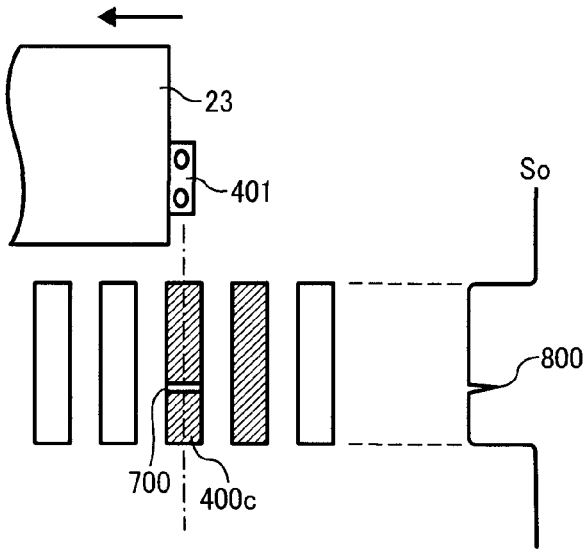

FIGS. 20A through 20C are explanatory views illustrating reading of the detection pattern performed by the read sensor 401.

After the nozzle defect detection pattern 400 is formed on the transfer belt 31, the carriage 23 moves rearward and stops above the defective nozzle detection pattern 400*k* as shown in FIG. 20A. The position of the carriage 23 is detected by the linear encoder 129 so as to accurately locate the carriage 23 above the selected detection pattern. When the carriage 23 becomes still after the motion, the transfer belt 31 moves in a direction opposite to the sheet feed direction and stops with a sufficient distance between the upper end of the detection pattern 400*y* and the read sensor 401. Thereafter, the transfer belt 31 moves in a reverse direction so as to move the spot 401*a* of the read sensor 401 over the detection pattern 400*y* from side to side at a constant speed. When the recording head 24*y* has no nozzle defect and properly operates, the sensor output So is uniformly low over a range corresponding to the upper and lower ends of the detection pattern 400*y*, indicating that no defective nozzle is present.

When the detection of the detection pattern 400*y* completes in such a manner, the same operation may be repeated for the pattern 400*y* by moving the transfer belt 31 in the reverse direction without moving the carriage 23 before performing the detection of the detection pattern 400*m* adjacent thereto. Such repeated operation may enhance the reliability of pattern detection.

When detecting the detection pattern 400*m*, the carriage 23 moves in the main scan direction so that the read sensor 401 moves to overlap the detection pattern 400*m* as shown in FIG. 20B. The pattern detection is performed for the detection pattern 400*m* in a manner similar to that depicted above. When the recording head 24*m* has no nozzle defect and properly operates, the sensor output So is uniformly low over a range corresponding to the upper and lower ends of the detection pattern 400*m*, indicating that no defective nozzle is present.

When detecting the detection pattern 400*c*, the carriage 23 moves in the main scan direction so that the read sensor 401 moves to overlap the detection pattern 400*c* as shown in FIG. 20C. The pattern detection is performed for the detection pattern 400*c* in a manner similar to that depicted above. In the illustrated example, the recording head 24*c* has a defective nozzle which causes a blank portion 700 in the detection pattern 400*c*. Correspondingly, the sensor output So is generally low over a range corresponding to the upper and lower ends of the detection pattern 400*m* with a prominence 800 indicating the presence of a defective nozzle.

The sensor output So may be analyzed by comparison with a given threshold value or by emphasizing the amount of variation through a differentiation circuit. When detecting a defective nozzle, a retry may be made to enhance the reliability of pattern detection. It is also contemplated that after one line of a particular detection pattern is scanned, another line of the same detection pattern may be scanned with the carriage 23 slightly shifting in the main scan direction.

After performing the pattern detection for every recording head 24 and there is no defective nozzle detected, the image forming apparatus 1 cleans the transfer belt 21 to complete the whole process.

When a defective nozzle is detected during the process, the image forming apparatus 1 may perform the recovery operation on the recording head with the nozzle defect, such as wiping, ink suction, and/or refreshing. After the recovery operation, the image forming apparatus 1 may again perform the pattern detection process to check the recovered recording head. Also, the recovery operation can be varied depending on the degree of the nozzle defect detected, for example, wiping for a small defect, ink suction for a moderate defect, and refreshing for a severe defect. In addition, when a nozzle defect is indicated multiple times after the recovery operation, the image forming apparatus 1 dispatches a service call, or issues a request to a user to perform a manual operation for recovery.

The image forming apparatus 1 according to this patent specification includes a recording head, a water-repellent member or transfer belt, a pattern formation controller, a read unit or sensor, and a defective nozzle detection unit. The recording head has a plurality of nozzles aligned in a given direction, and serves to eject droplets of a liquid from the plurality of nozzles. The pattern formation controller serves to direct each of the plurality of nozzles to eject the liquid to form a detection pattern on the transfer belt. The detection pattern has multiple droplets sequentially arranged and spaced apart from each other. The read unit includes a light emitting element for illuminating the detection pattern on the transfer belt, and a light receiving element for receiving specular light reflected from the detection pattern, and serves to read the detection pattern to output a read result or sensor output. The detection unit serves to detect a defective nozzle according to the read result. Such a configuration achieves accurate detection of nozzle defects in the image forming apparatus according to this patent specification.

Further, the defective nozzle detection according to this patent specification includes a pattern formation step, a pattern reading step, and a pattern detection step, and can be used in an image forming apparatus that includes a recording head having a plurality of nozzles aligned in a given direction used to eject droplets of a liquid therefrom, and a transfer belt being water-repellent and used to convey a recording medium thereon. The pattern formation step directs each of the plurality of nozzles to eject the liquid to form a detection pattern on a water-repellent member. The detection pattern has multiple droplets sequentially arranged and spaced apart from each other. The pattern reading step reads the detection pattern to output a read result or sensor output by illuminating the detection pattern on the transfer belt, and receiving specular light reflected from the detection pattern. The pattern detection step detects a defective nozzle according to the read result. Such a method achieves accurate detection of nozzle defects in the image forming apparatus according to this patent specification.

Figure 21:
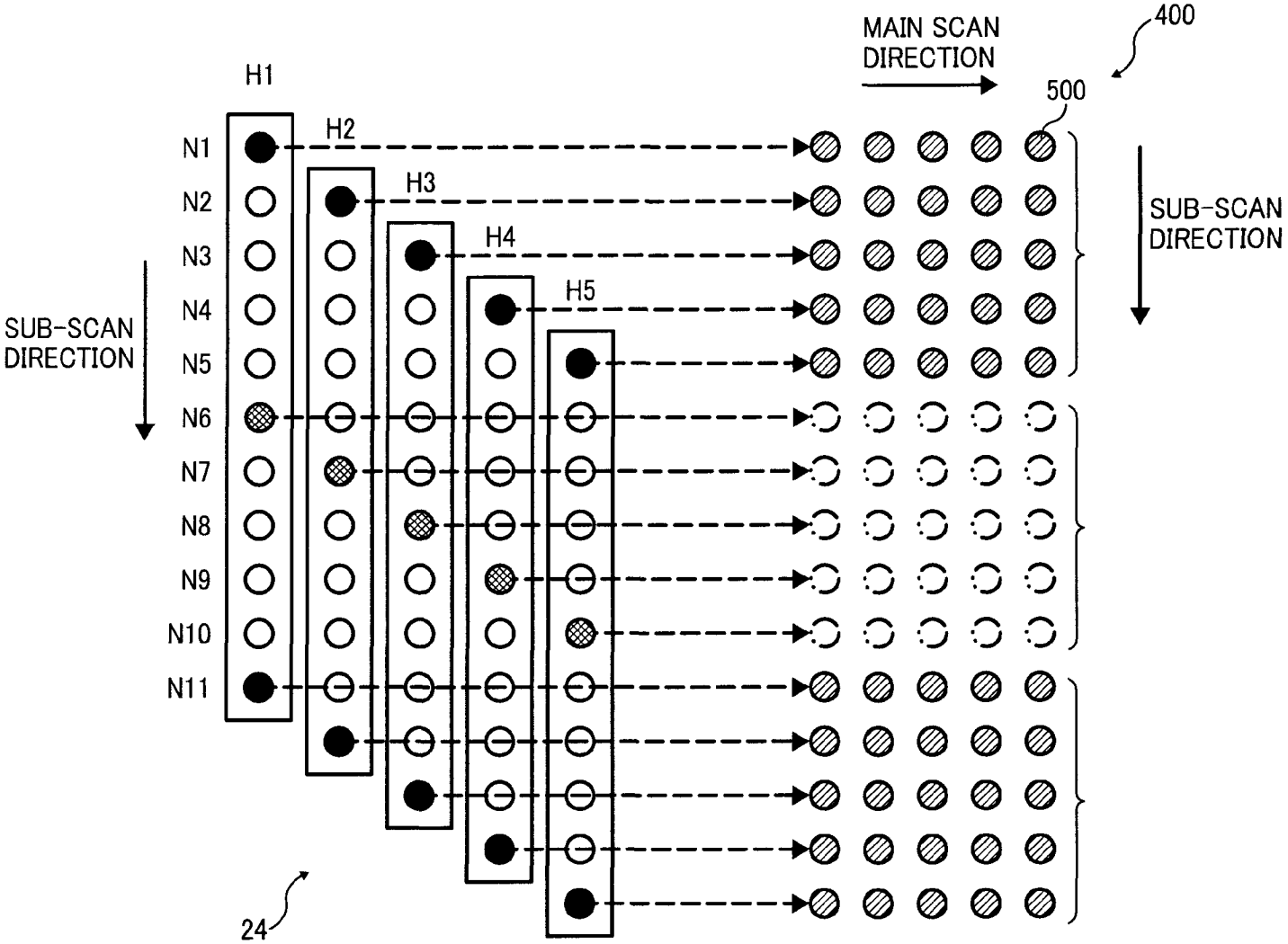
FIG. 21 is a schematic diagram illustrating formation of the detection pattern according to another embodiment of this patent specification.

Referring now to FIG. 21, a schematic diagram illustrating formation of the detection pattern 400 according to another embodiment of this patent specification is described.

The embodiment illustrates an example where the detection pattern 400 has multiple droplets ejected from each of the plurality of nozzles sequentially arranged and spaced apart from each other both in the sub-scan direction (i.e., along the rows of nozzles) and in the main scan direction which is orthogonal to the sub-scan direction.

It is to be noted that, in the embodiment described in FIGS. 17 through 19, the detection pattern 400 has multiple droplets ejected from each of the plurality of nozzles sequentially arranged and spaced apart from each other only in the main scan direction (i.e., transverse the rows of nozzles). In such cases, presence of a single defective nozzle is indicated by a single line of defective-indicative blank portion in the pattern matrix (see FIG. 19), which may result in insufficient variation of the sensor output So. The embodiment illustrated hereinbelow enhances accuracy of pattern detection by configuring the detection pattern 400 to have droplets ejected from each of the plurality of nozzles sequentially arranged and spaced apart from each other both in the main scan direction and in the sub-scan direction, so as to enlarge the defective-indicative blank portion in the pattern matrix.

In FIG. 21, the recording head 24 is assumed to include first through eleventh nozzles N1 through N11 with the sixth nozzle N6 being a defective nozzle, where a nozzle that is not activated is indicated by white circles, a nozzle that is activated to eject droplets is indicated by black circles, and a defective nozzle is indicated by checked circles.

As shown in FIG. 21, the recording head 24 activates the first, sixth, and eleventh nozzles N1, N6, and N11 in a position H1. Upon the activation, the first and eleventh nozzles N1 and N11 each ejects droplets 500 (indicated by shaded circles), but the sixth nozzle N6 does not operate (indicated by dotted circles). The recording head 24 moves in the main scan direction while directing each of the three nozzles to deposit 5 droplets, so that the first and eleventh nozzle N1 and N11 each forms a row of 5 droplets along the main scan direction and the sixth nozzle N6 fails to form such a droplet row.

The recording head 24 then shifts to a position H2 in the sub-scan direction and activates the first, sixth, and eleventh nozzles N1, N6, and N11. Upon the activation, the first and eleventh nozzles N1 and N11 each ejects droplets 500 (indicated by shaded circles), but the sixth nozzle N6 does not operate (indicated by dotted circles). The recording head 24 moves in the main scan direction while directing each of the three nozzles to deposit 5 droplets, so that the first and eleventh nozzle N1 and N11 each forms a row of 5 droplets along the main scan direction and the sixth nozzle N6 fails to form such a droplet row.

Thereafter, the recording head 24 sequentially shifts to different positions H3, H4, and H5 to perform the similar operation, thus forming the detection patter 400 having a 5-by-5 dot matrix for each of the first and eleventh nozzle N1 and N11 and a blank portion for the defective nozzle N6.

Compared to the case of FIGS. 18 and 19, the configuration depicted in FIG. 21 enlarges the defective-indicative blank portion of the detection pattern 400 in the sub-scan direction, so that the read sensor 401 can reliably and accurately detect the defective-indicative blank portion which is sufficiently larger than the sensor spot diameter.

Figure 22:
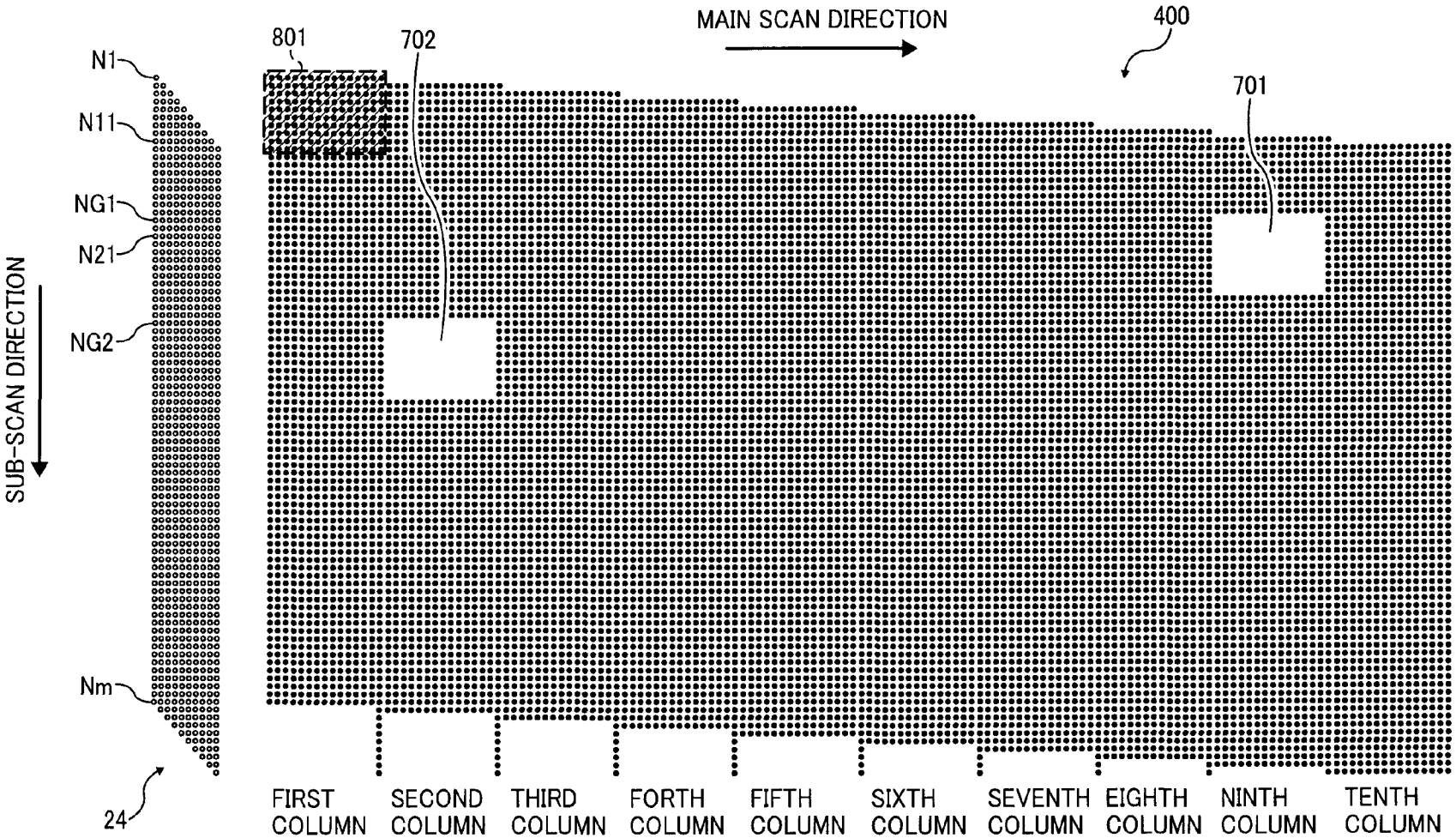
FIG. 22 is a schematic diagram illustrating an example of the detection pattern according to the embodiment of FIG. 21.

FIG. 22 is a schematic diagram illustrating an example of the detection pattern 400 according to the pattern formation illustrated in FIG. 21, assuming a case where each nozzle is activated to form a 10-by-10 matrix in the detection pattern 400.

As shown in FIG. 22, the recording head 24 is shifted in the sub-scan direction to 10 different positions corresponding to a row of 10 nozzles while ejecting droplets from every 10-th nozzle among first through m-th nozzles N1 through Nm, thus forming a 10-by-10 dot matrix for each activated nozzle in the detection pattern 400. The resulting detection pattern 400 has blank portions 701 and 702, indicating that the recording head 24 includes defective nozzles NG1 and NG2.

Specifically, in the formation of the detection pattern 400, the recording head 24 ejects droplets by activating every (10n+1)-th nozzle (i.e., the first, eleventh, and twenty-first nozzles N1, N11, and N21, for example) so that each of the activated nozzles forms a first line of 10 droplets parallel to the main scan direction in a first column. Then, the carriage 23 moves to a second position and the recording head 24 ejects droplets by activating every (10n+2)-th nozzle (i.e., the second, twentieth, and twenty-second nozzles N2, N12, and N22, for example) so that each of the activated nozzles forms a first line of 10 droplets parallel to the main scan direction in a second column. Likewise, the carriage 23 moves to third through tenth positions so that each nozzle of the recording head 24 forms a first line in third through tenth columns. Meanwhile, the recording head 24 is shifted relative to the transfer belt 31, so that each nozzle forms a 10-by-10 dot matrix. For example, the first nozzle N1 creates a matrix 801 in the detection pattern 400 of FIG. 22.

As a result of such an operation, the blank portions 701 and 702 are created in the detection pattern 400 when the nozzles NG1 and NG2 fail to eject droplets.

Figure 23:
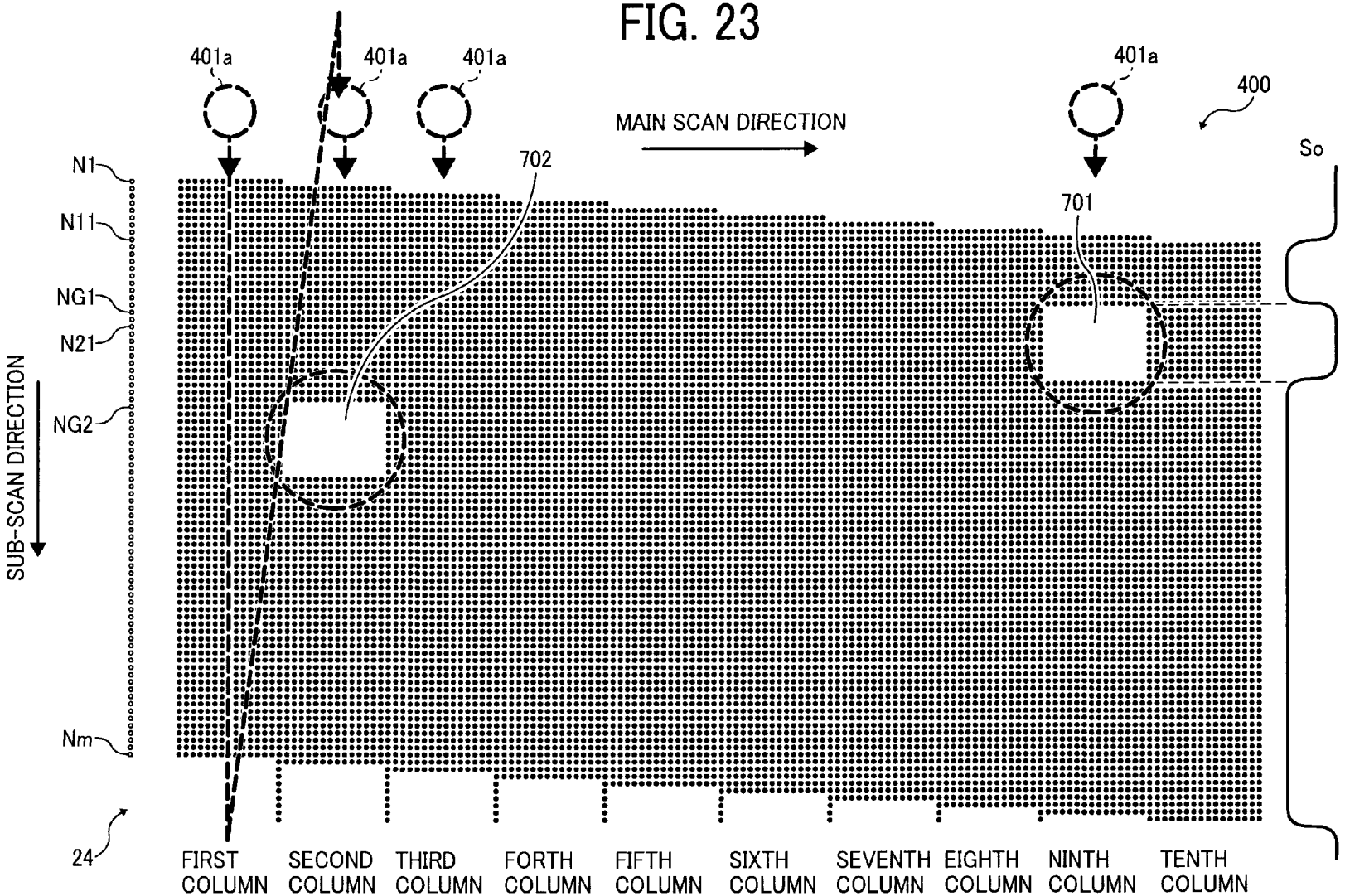
FIG. 23 is a schematic diagram illustrating reading of the detection pattern according to the embodiment of FIG. 21 together with a corresponding sensor output.

FIG. 23 is a schematic diagram illustrating reading of the detection pattern depicted in the example of FIG. 22, together with a corresponding sensor output.

As shown in FIG. 23, in the pattern reading, the carriage 23 moves to a first position so that the read sensor 401 directs the sensor spot 401*a* to the first column of the detection pattern 400. Then, the transfer belt 31 moves relative to the sensor spot 401*a*, for example, in the sub-scan direction to cause the sensor spot 401*a* to scan in a vertical direction as indicated by a dotted arrow in FIG. 23. When the read sensor 401 reads the first column of the detection pattern 400, the carriage 23 shifts to a second position so that the read sensor 401 directs the sensor spot 401*a* to the second column of the detection pattern 400, while the transfer belt 31 is moved backward to the initial position. Then, the transfer belt 31 moves relative to the sensor spot 401*a*, which now reads the second column of the detection pattern 400. The shifting of the carriage 23 and the movement of the transfer belt 31 are repeated so that the read sensor 400 may read the first through tenth columns of the detection pattern 400.

Since the detection pattern 400 includes the blank portion 701, the sensor output So resulting from reading the ninth column of the detection pattern 400 has a corresponding prominence in voltage as shown in FIG. 23, indicating the presence of a defective nozzle.

In the embodiment illustrated above, the detection pattern 400 has multiple droplets ejected from each of the plurality of nozzles sequentially arranged and spaced apart from each other both in the sub-scan direction and in the main scan direction. Such a configuration enlarges the defective-indicative blank portion of the detection pattern 400 in the sub-scan direction, so that the read sensor 401 can reliably and accurately detect the blank portion which is sufficiently larger than the sensor spot diameter.

For comparison purposes, consider a case where the detection pattern has multiple droplets ejected from each of the plurality of nozzles sequentially arranged and spaced apart from each other only in the main scan direction, as depicted hereinbelow referring to FIGS. 24 and 25.

Figure 24:
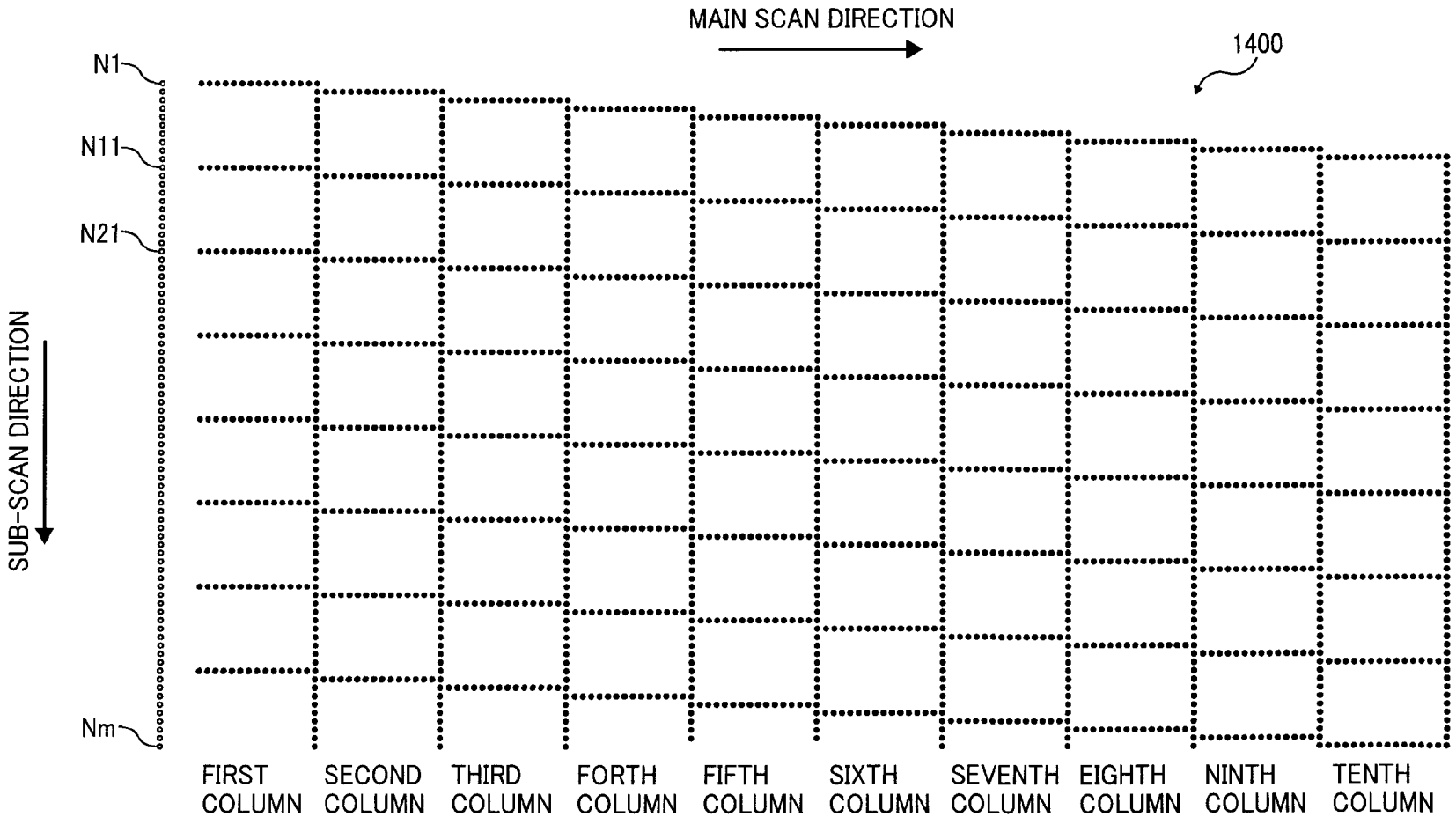
FIG. 24 is a schematic diagram illustrating an example of a detection pattern.

In FIG. 24, a detection pattern 1400 includes 10 droplets ejected from each of the plurality of nozzles sequentially arranged and spaced apart from each other only in the main scan direction.

Specifically, in the formation of the detection pattern 1400, a recording head ejects droplets by activating every (10n+1)-th nozzle (i.e., the first, eleventh, and twenty-first nozzles N1, N11, and N21, for example) so that each of the activated nozzles forms a single line of 10 droplets parallel to the main scan direction in a first column. Then, the carriage moves to a second position and the recording head ejects droplets by activating every (10n+2)-th nozzle (i.e., the second, twentieth, and twenty-second nozzles N2, N12, and N22, for example) so that each of the activated nozzles forms a single line of 10 droplets parallel to the main scan direction in a second column. Likewise, the carriage moves to third through tenth positions so that each nozzle of the recording head forms a single line also in third through tenth columns.

The detection pattern 1400 thus created includes multiple horizontal lines corresponding to the multiple nozzles, with vertical lines formed by activating all the nozzles between columns.

Figure 25:
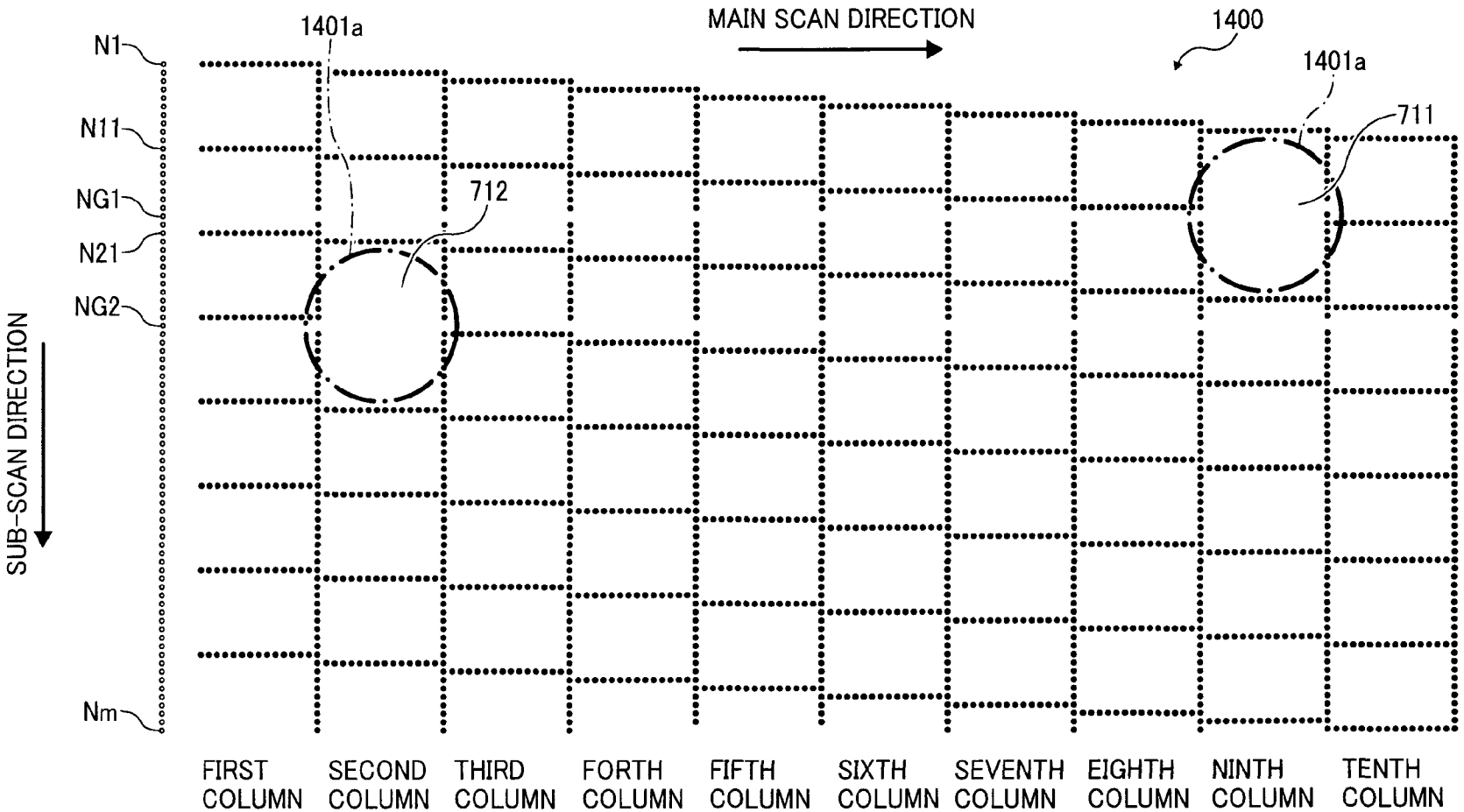
FIG. 25 is a schematic diagram illustrating reading of the detection pattern illustrated in FIG. 24.

FIG. 25 is a schematic diagram illustrating reading of the detection pattern 1400.

Note that the example of FIG. 25 assumes a case where the recording head includes defective nozzles NG1 and NG2, so that the resulting detection pattern 1400 includes corresponding blank portions 711 and 712, and the read sensor has a sensor spot 1401*a* with a diameter greater than the width of each column of the detection pattern 1400.

As shown in FIG. 25, the sensor spot 1401*a* scans the areas of the detection pattern 1400, which are generally blank with only a single line indicating the proper operation of each nozzle. As these general blank portions are not much different from the defective-indicative blank portions 711 and 712, the read sensor outputs only a small voltage difference indicating the presence of the blank portions. Naturally, this significantly affects the accuracy in detecting the detection pattern.

By contrast, the detection pattern 400 according to this patent specification has multiple droplets ejected from each of the plurality of nozzles sequentially arranged and spaced apart from each other both in the sub-scan direction and in the main scan direction, thereby enlarging the defective-indicative blank portion in the sub-scan direction, so that the read sensor 401 can reliably and accurately detect the blank portion which is sufficiently larger than the sensor spot diameter.

The image forming apparatus 1 according to this patent specification includes a recording head, a transfer belt, a pattern formation controller, a read unit or sensor, and a defective nozzle detection unit. The recording head has a plurality of nozzles aligned in a given direction, and serves to eject droplets of a liquid from the plurality of nozzles. The transfer belt is water-repellent and serves to convey a recording medium thereon. The pattern formation controller serves to direct each of the plurality of nozzles to eject the liquid to form a detection pattern on the transfer belt. Alternatively, the detection pattern may be formed on an appropriate recording medium, such as an overhead transparency film, with the transfer belt capable of reverse rotation. The detection pattern has multiple droplets ejected from each of the plurality of nozzles sequentially arranged and spaced apart from each other both in the sub-scan direction and in the main scan direction. The read unit includes a light emitting element for illuminating the detection pattern on the transfer belt, and a light receiving element for receiving specular light reflected from the detection pattern, and serves to read the detection pattern to output a read result or sensor output. The detection unit serves to detect a defective nozzle according to the read result. Such a configuration achieves accurate detection of nozzle defects in the image forming apparatus according to this patent specification.

Further, the image forming apparatus 1 according to this patent specification includes a recording head, a pattern formation controller, a read unit or sensor, and a defective nozzle detection unit. The recording head has a plurality of nozzles aligned in a given direction, and serves to eject droplets of a liquid from the plurality of nozzles. The pattern formation controller serves to direct each of the plurality of nozzles to eject the liquid to form a detection pattern on a water-repellent member. The detection pattern has multiple droplets ejected from each of the plurality of nozzles sequentially arranged and spaced apart from each other both in the sub-scan direction and in the main scan direction. The read unit includes a light emitting element for illuminating the detection pattern on the water-repellent member, and a light receiving element for receiving specular light reflected from the detection pattern, and serves to read the detection pattern to output a read result or sensor output. The detection unit serves to detect a defective nozzle according to the read result. Such a configuration achieves accurate detection of nozzle defects in the image forming apparatus according to this patent specification.

Still further, the defective nozzle detection according to this patent specification includes a pattern formation step, a pattern reading step, and a pattern detection step, and can be used in an image forming apparatus that includes a recording head having a plurality of nozzles aligned in a given direction used to eject droplets of a liquid therefrom, and a transfer belt being water-repellent and used to convey a recording medium thereon. The pattern formation step directs each of the plurality of nozzles to eject the liquid to form a detection pattern on a water-repellent member. The detection pattern has multiple droplets ejected from each of the plurality of nozzles sequentially arranged and spaced apart from each other both in the sub-scan direction and in the main scan direction. The pattern reading step reads the detection pattern to output a read result or sensor output by illuminating the detection pattern on the transfer belt, and receiving specular light reflected from the detection pattern. The pattern detection step detects a defective nozzle according to the read result.

Such a method achieves accurate detection of nozzle defects in the image forming apparatus according to this patent specification.

Numerous additional modifications and variations are possible in light of the above teachings. It is therefore to be understood that, within the scope of the appended claims, the disclosure of this patent specification may be practiced otherwise than as specifically described herein.

This patent specification is based on Japanese patent application, No. JPAP2007-171091 filed on Jun. 28, 2007 in the Japanese Patent Office, the entire contents of which are incorporated by reference herein.

What is claimed is:

1. A method of detecting a defective nozzle in an image forming apparatus that includes a recording head having a plurality of nozzles aligned in a first direction used to eject droplets of a liquid therefrom, the method comprising:

(a) controlling each of the plurality of nozzles to eject the liquid to form a detection pattern on a water-repellent surface, the detection pattern being formed by multiple droplets ejected from each operational nozzle of the plurality of nozzles, the multiple droplets ejected by the operational nozzle being sequentially arranged and spaced apart from each other both in the first direction and in a second direction orthogonal to the first direction to form together a generally rectangular configuration extending in both of the first and second directions on the water-repellent surface;

(b) reading the detection pattern by a read sensor illuminating the detection pattern on the water-repellent surface, and receiving specular light reflected from the detection pattern, the read sensor having a detecting range;

(c1) outputting a first read result when sensing a first area of the detection pattern on the water-repellent surface, the first area not having an ink droplet disposed thereon, due to the defective nozzle failing to eject liquid droplets, and therefore the first area reflecting a relatively large amount of specular light, and (c2) outputting a second read result when sensing a second area of the detection pattern on the water-repellent surface, the second area having a plurality of ink droplets disposed thereon with a hemispherical shiny surface to reflect a relatively small amount of specular light; and (d) detecting the defective nozzle according to the first and second read results collectively indicating an edge formed between the first area and second area, wherein the first area of the detection pattern, created due to the defective nozzle failing to eject liquid droplets onto the water-repellent surface, is larger than the detecting range of the read sensor detecting the detection pattern in at least one of the first and second directions.

2. The method of claim 1, wherein the plurality of ink droplets disposed on the water-repellent surface are spaced apart from each other both in the first direction and in the second direction, and a center-to-center distance between adjacent ones of the plurality of ink droplets does not exceed approximately 84 micrometers.

3. The method of claim 1, wherein the multiple droplets sequentially arranged to form the detection pattern are spaced at a linear spacing corresponding to no less than 300 droplets per inch.

4. The method of claim 1, wherein the multiple droplets forming the detection pattern reflect light containing a constant ratio of diffused light.

5. The method of claim 1, wherein each of the multiple droplets forming the detection pattern contacts the water-repellent surface with a constant contact surface area.

6. The method of claim 1, wherein the detection pattern is read in (b) after a given time has elapsed since the detection pattern is formed in (a).

7. The method of claim 1, further comprising:

moving the recording head at a constant speed while the plurality of nozzles repeatedly eject the multiple droplets, to form the detection pattern with a length greater than a spot diameter of light emitted by the light emitting element.

8. The method of claim 1, wherein the multiple droplets forming the detection pattern with the center-to-center distance between adjacent ones of the ink droplets reflects light containing a constant ratio of diffused light.

9. The method of claim 1, wherein the water-repellent surface is on a transfer belt configured to convey a recording medium disposed thereon in the image forming apparatus.

10. The method of claim 1, wherein the water-repellent surface is on a recording medium conveyed on a transfer belt in the image forming apparatus.

11. A method for detecting a defective nozzle in an image forming apparatus that includes a recording head having a plurality of nozzles aligned in a first direction used to eject droplets of a liquid therefrom, the method comprising:

(a) controlling each of the plurality of nozzles to eject the liquid to form a detection pattern on a water-repellent member, the detection pattern being formed by multiple droplets ejected from each operational nozzle of the plurality of nozzles, the multiple droplets ejected by the operational nozzle being sequentially arranged and spaced apart from each other both in the first direction and in a second direction orthogonal to the first direction to form together a generally rectangular configuration extending in both of the first and second directions on the water-repellent member;

(b) reading the detection pattern by a read sensor illuminating the detection pattern on the water-repellent member, and receiving specular light reflected from the detection pattern, the read sensor having a detecting range;

(c1) outputting a first read result when sensing a first area of the detection pattern on the water-repellent member, the first area not having an ink droplet disposed thereon, due to the defective nozzle failing to eject liquid droplets, and therefore the first area reflecting a relatively large amount of specular light, and (c2) outputting a second read result when sensing a second area of the detection pattern on the water-repellent member, the second area having a plurality of ink droplets disposed thereon with a hemispherical shiny surface to reflect a relatively small amount of specular light; and (d) detecting the defective nozzle according to the first and second read results collectively indicating an edge formed between the first area and second area, wherein the first area of the detection pattern, created due to the defective nozzle failing to eject liquid droplets onto the water-repellent surface, is larger than the detecting range of the read sensor detecting the detection pattern in at least one of the first and second directions.

12. The method of claim 11, wherein the plurality of ink droplets disposed on the water-repellent member are spaced apart from each other both in the first direction and in the second direction, and a center-to-center distance between adjacent ones of the plurality of ink droplets does not exceed approximately 84 micrometers.

13. The method of claim 11, wherein the multiple droplets sequentially arranged to form the detection pattern are spaced at a linear spacing corresponding to no less than 300 droplets per inch.

14. The method of claim 11, wherein the multiple droplets forming the detection pattern reflect light containing a constant ratio of diffused light.

15. The method of claim 11, wherein each of the multiple droplets forming the detection pattern contacts the water-repellent member with a constant contact surface area.

16. The method of claim 11, wherein the detection pattern is read in (b) after a given time has elapsed since the detection pattern is formed in (a).

17. The method of claim 11, further comprising:

moving the recording head at a constant speed while the plurality of nozzles repeatedly eject the multiple droplets, to form the detection pattern with a length greater than a spot diameter of light emitted by the light emitting element.

18. The method of claim 11, wherein the multiple droplets forming the detection pattern with the center-to-center distance between adjacent ones of the ink droplets reflects light containing a constant ratio of diffused light.

* * * * *